US010549287B2

(12) United States Patent
Rohde et al.

(10) Patent No.: US 10,549,287 B2
(45) Date of Patent: Feb. 4, 2020

(54) ULTRAFLOTATION WITH MAGNETICALLY RESPONSIVE CARRIER PARTICLES

(71) Applicant: BASF SE, Ludwigshafen am Rhein (DE)

(72) Inventors: Wolfgang Rohde, Speyer (DE); Alexej Michailovski, Ludwigshafen (DE); Igor Shishkov, Muenster (DE); Reinhold Rieger, Mutterstadt (DE); Gerardo Incera Garrido, Ludwigshafen (DE); Piyada Charoensirisomboon, Mannheim (DE); Darren Megaw, Johannesburg (ZA); David Johann Gilbert, Villach (AT)

(73) Assignee: BASF SE, Ludwigshafen am Rhein (DE)

( * ) Notice: Subject to any disclaimer, the term of this patent is extended or adjusted under 35 U.S.C. 154(b) by 33 days.

(21) Appl. No.: 16/062,904

(22) PCT Filed: Dec. 7, 2016

(86) PCT No.: PCT/EP2016/080122
§ 371 (c)(1),
(2) Date: Jun. 15, 2018

(87) PCT Pub. No.: WO2017/102512
PCT Pub. Date: Jun. 22, 2017

(65) Prior Publication Data

US 2018/0369834 A1 Dec. 27, 2018

(30) Foreign Application Priority Data

Dec. 17, 2015 (EP) ..... 15200912

(51) Int. Cl.
*B03D 1/02* (2006.01)
*B03C 1/01* (2006.01)
*B03C 1/30* (2006.01)
*B03D 1/08* (2006.01)

(52) U.S. Cl.
CPC ..... *B03D 1/023* (2013.01); *B03C 1/01* (2013.01); *B03C 1/30* (2013.01); *B03D 1/082* (2013.01); *B03C 2201/20* (2013.01); *B03D 2203/02* (2013.01); *B03D 2203/025* (2013.01)

(58) Field of Classification Search
CPC .... B03D 1/023; B03D 1/082; B03D 2203/02; B03D 2203/025; B03D 2201/20; B03C 1/01; B03C 1/30; B03C 2201/20
USPC ..... 209/39, 166
See application file for complete search history.

(56) References Cited

U.S. PATENT DOCUMENTS

| | | | |
|---|---|---|---|
| 4,343,694 | A | 8/1982 | Cook et al. |
| 4,657,666 | A | 4/1987 | Snook et al. |
| 5,051,199 | A | 9/1991 | Barwise |
| 5,349,106 | A | 9/1994 | Behler et al. |
| 5,670,677 | A | 9/1997 | Ponsati Obiols et al. |
| 5,869,716 | A | 2/1999 | Pi Subirana et al. |
| 5,880,299 | A | 3/1999 | Ponsati Obiols et al. |
| 8,329,039 | B2 | 12/2012 | Domke et al. |
| 8,377,311 | B2 | 2/2013 | Domke et al. |
| 8,377,312 | B2 | 2/2013 | Domke et al. |
| 8,377,313 | B2 | 2/2013 | Domke et al. |
| 8,408,395 | B2 | 4/2013 | Domke et al. |
| 8,434,623 | B2 | 5/2013 | Domke et al. |
| 8,715,494 | B2 | 5/2014 | Danov et al. |
| 8,858,801 | B2 | 10/2014 | Domke et al. |
| 9,028,687 | B2 | 5/2015 | Goraj |
| 9,028,699 | B2 | 5/2015 | Danov et al. |
| 9,126,206 | B2 | 9/2015 | Hartmann et al. |
| 9,932,525 | B2 * | 4/2018 | Kersey |
| 9,981,271 | B2 * | 5/2018 | Rothman |
| 2012/0132032 | A1 | 5/2012 | Domke et al. |
| 2013/0087505 | A1 | 4/2013 | Danov et al. |
| 2013/0256233 | A1 | 10/2013 | Danov et al. |
| 2013/0313177 | A1 | 11/2013 | Danov et al. |
| 2016/0317951 | A1 | 11/2016 | Incera Garrido et al. |
| 2016/0339446 | A1 | 11/2016 | Blasberg et al. |
| 2017/0274389 | A1 | 9/2017 | Shishkov et al. |
| 2017/0320068 | A1 | 11/2017 | Incera Garrido et al. |
| 2018/0169664 | A1 | 6/2018 | Garrido |
| 2018/0179461 | A1 | 6/2018 | Michailovski et al. |

FOREIGN PATENT DOCUMENTS

| | | | |
|---|---|---|---|
| AU | 774023 | B2 | 2/2001 |
| AU | 2011224015 | A1 | 4/2012 |
| CA | 2832814 | A1 | 10/2012 |
| DE | 64275 | A5 | 10/1968 |
| DE | 2547987 | A1 | 4/1977 |
| DE | 4026184 | A1 | 2/1992 |
| DE | 4308792 | C1 | 4/1994 |
| DE | 4409322 | C1 | 4/1995 |
| DE | 102010023130 | A1 | 12/2011 |
| DE | 202011104707 | U1 | 2/2012 |
| DE | 102010061952 | A1 | 5/2012 |
| EP | 0770594 | B1 | 2/1997 |
| EP | 1200408 | A2 | 5/2002 |
| WO | WO-9101295 | A1 | 2/1991 |
| WO | WO-0109099 | A2 | 2/2001 |
| WO | WO-020066168 | A1 | 8/2002 |
| WO | WO-2009010422 | A1 | 1/2009 |
| WO | WO-2009065802 | A2 | 5/2009 |

(Continued)

OTHER PUBLICATIONS

European Search Report for EP Patent Application No. 15200912.2, dated Jun. 21, 2016.

(Continued)

*Primary Examiner* — Thomas M Lithgow
(74) *Attorney, Agent, or Firm* — Drinker Biddle & Reath LLP

(57) ABSTRACT

The present invention relates to a process for the separation of at least one hydrophobic or hydrophobized material from a dispersion comprising said at least one hydrophobic or hydrophobized material and at least one second material. The process according to the present invention comprises the steps (A) to (D) which are described herein.

20 Claims, No Drawings

(56) References Cited

FOREIGN PATENT DOCUMENTS

| | | | |
|---|---|---|---|
| WO | WO-2010007075 | A1 | 1/2010 |
| WO | WO-2010007157 | A1 | 1/2010 |
| WO | WO-2010066770 | A1 | 6/2010 |
| WO | WO-2010097361 | A1 | 9/2010 |
| WO | WO-2010100180 | A1 | 9/2010 |
| WO | WO-2011107353 | A1 | 9/2011 |
| WO | WO-2011120826 | A1 | 10/2011 |
| WO | WO-2011131411 | A1 | 10/2011 |
| WO | WO-2011134710 | A1 | 11/2011 |
| WO | WO-2011154178 | A1 | 12/2011 |
| WO | WO-2012104292 | A1 | 8/2012 |
| WO | WO-2012107274 | A1 | 8/2012 |
| WO | WO-2012116909 | A1 | 9/2012 |
| WO | WO-2012140065 | A1 | 10/2012 |
| WO | WO-2013038192 | A1 | 3/2013 |
| WO | WO-2013130794 | A1 | 9/2013 |
| WO | WO-2013167634 | A1 | 11/2013 |
| WO | WO-2013177267 | A1 | 11/2013 |

OTHER PUBLICATIONS

International Search Report for PCT/EP2016/080122 dated Mar. 7, 2017.
Written Opinion of the International Searching Authority for PCT/EP2016/080122 dated Mar. 7, 2017.

* cited by examiner

ULTRAFLOTATION WITH MAGNETICALLY RESPONSIVE CARRIER PARTICLES

CROSS-REFERENCE TO REALATED APPLICATIONS

This application is a national stage application (under 35 U.S.C. § 371) of PCT/EP2016/080122, filed Dec. 7, 2016, which claims benefit of European Application No. 15200912.2, filed Dec. 17, 2015, both of which are incorporated herein by reference in their entirety.

The present invention relates to a process for the separation of at least one hydrophobic or hydrophobized material from a dispersion comprising said at least one hydrophobic or hydrophobized material and at least one second material.

BACKGROUND OF THE INVENTION

Several processes for the separation of a desired material from a mixture comprising this desired material and, in addition, undesired materials are described in the prior art.

WO 02/066168 A1 relates to a process for separating ores from mixtures comprising these, in which suspensions or slurries of these mixtures are treated with particles which are magnetic and/or capable of floating and/or reporting to the froth phase of flotation in aqueous solutions. After addition of the magnetic particles and/or particles capable of floating, a magnetic field is applied so that the agglomerates are separated from the mixture. However, the extent to which the magnetic particles are bound to the ore and the strength of the bond is not sufficient for the process to be carried out with a satisfactorily high yield and effectiveness.

U.S. Pat. No. 4,657,666 discloses a process for the enrichment of ore minerals, in which the ore mineral present in the gangue is treated with magnetic particles, as a result of which agglomerates are formed due to hydrophobic interactions. The magnetic particles are hydrophobized on the surface by treatment with hydrophobic compounds, so that agglomeration to the ore minerals occurs. The agglomerates are then separated off from the mixture by means of a magnetic field. It is disclosed that the ores are treated with a surface-activating solution of sodium ethylxanthate, which may also be called sodium ethylxanthogenate, before the magnetic particle is added. In this process, separation of ore minerals and magnetic particle is effected by the destruction of the surface-activating substance which has been applied in the form of the surface-activating solution to the ore.

WO 2010/100180 A1 relates to an agglomerate of at least one particle P which is hydrophobized on the surface with at least one first surface-active substance and at least one magnetic particle MP which is hydrophobized on the surface with at least one second surface-active substance, a process for producing these agglomerates and the use of the agglomerates for separating a particle P from mixtures comprising these particles P and further components.

WO 2010/097361 A1 relates to a process for separating at least one first material from a mixture comprising this at least one first material, at least one second material and at least one third material, wherein the mixture to be treated is firstly brought into contact with at least one hydrocarbon in an amount of from 0.01 to 0.4% by weight, based on the sum of mixture and at least one hydrocarbon, this mixture is further brought into contact with at least one hydrophobic magnetic particle so that the magnetic particle and the at least one first material agglomerate and this agglomerate is separated from the at least one second material and the at least one third material by application of a magnetic field and, if appropriate, the at least one first material is subsequently separated, preferably quantitatively, from the magnetic particle, with the magnetic particle preferably being able to be recirculated to the process.

WO 2010/066770 A1 discloses a process for separating at least one first material from a mixture comprising this at least one first material in an amount of from 0.001 to 1.0% by weight, based on the total mixture, and at least one second material, in which the first material is firstly brought into contact with a surface-active substance in order to hydrophobize it, i.e. to render it hydrophobic, this mixture is then brought into contact with at least one magnetic particle so that the magnetic particle and the hydrophobized first material agglomerate and this agglomerate is separated from the at least one second material by application of a magnetic field and the at least one first material is then preferably quantitatively separated from the magnetic particle, with the magnetic particle preferably being able to be recirculated to the process.

WO 2010/007157 A1 discloses a process for separating at least one first material from a mixture comprising this at least one first material and at least one second material, in which the mixture to be separated is firstly brought into contact with at least one selective hydrophobizing agent so that an adduct is formed from the at least one hydrophobizing agent and the at least one first material, this adduct is then brought into contact with at least one magnetic particle functionalized on the surface with at least one polymeric compound having an LOST (lower critical solution temperature) at a temperature at which the polymeric compound has hydrophobic character so that the adduct and the at least one functionalized magnetic particle agglomerate, this agglomerate is separated off by application of a magnetic field and the agglomerate is subsequently dissociated by setting a temperature at which the polymeric compound has hydrophilic character.

WO 2010/007075 A1 relates to a process for separating at least one first material from a mixture comprising this at least one first material and at least one second material, in which the mixture to be separated is brought into contact with at least one bifunctional compound and at least one magnetic particle so that an adduct is formed from the at least one first material, the at least one bifunctional compound and the at least one magnetic particle, this adduct is dispersed in a suitable dispersion medium, the adduct is separated off by application of a magnetic field and the adduct which has been separated off is, if appropriate, disassociated by suitable measures in order to obtain the at least one first material.

WO 2009/065802 A2 relates to a process for separating at least one first material from a mixture comprising this at least one first material and at least one second material, in which a suspension of the mixture comprising at least one first material and at least one second material and at least one magnetic particle in a suitable suspension medium is firstly produced, the pH of this suspension is set to a value at which the at least one first material and the at least one magnetic particle bear opposite surface charges so that these agglomerate, the agglomerates obtained in this way are separated off by application of a magnetic field gradient and the agglomerates which has been separated off are dissociated by setting the pH to a value at which the at least one first material and the at least one magnetic particle bear the same surface charges in order to obtain the at least one first material separately.

US 20120132032 A1 discloses a process for the separation of at least one metal from a slag, comprising that at least one metal and further components, comprising at least step (A) grinding the slag, (B) if appropriate, contacting the ground slag of step (A) with at least one surface-active substance and/or at least one magnetic particle, if appropriate in the presence of at least one dispersant, resulting in formation of agglomerates of the at least one metal and the at least one magnetic particle, (C) if appropriate, addition of at least one dispersant to the mixture obtained in step (B) to give a dispersion having a suitable concentration, and (D) separation of the agglomerates from the mixture of step (B) or (C) by application of a magnetic field, and to the use of at least one magnetic particle for the separation of slag. The use of magnetic particles can be optional if the slag contains magnetically separable, valuable-containing particles.

The processes for separating a desired valuable matter containing material from a mixture comprising this desired material and further undesired materials that are disclosed in the prior art can still be improved in respect of the separation efficiency, the yield of desired valuable matter and/or in respect of the grade of the obtained desired valuable material in agglomerates comprising the desired valuable matter containing material. An improvement of this separation process will further increase the efficiency of the whole valuable matter recovery process chain. For example, while increasing the separation efficiency of the process of the invention, smaller or less apparatuses for the separation can be used, so that the overall space-time yield of the valuable matter recovery process can be increased.

Further, the presence of disturbing and potentially toxic compounds, such as chromium or chromium comprising minerals, may also be undesired and for example may increase the risk of contamination of the personal handling the material. It is also known that chromium comprising minerals increase the melting point and thus lead to melt crystallization in a smelter oven affording high additional processing costs.

It is therefore an object of the present invention to provide a process for the separation of at least one valuable matter containing material from a dispersion that also comprises further undesired materials. Furthermore, it is an object of the present invention to provide a process which makes it possible to separate off the at least one valuable matter containing material efficiently. Furthermore, it is an object of the present invention to improve the yield of said at least one valuable matter containing material in said separation process.

It is also an object to provide a process for separating at least one hydrophobic or hydrophobized material from a dispersion comprising the at least one hydrophobic or hydrophobized material and at least one second material.

SUMMARY

These objects are solved by the process according to the present invention for the separation of at least one hydrophobic or hydrophobized material (e.g., at least one hydrophobic or hydrophobized valuable matter containing material) from a dispersion comprising said at least one hydrophobic or hydrophobized material (e.g., the at least one hydrophobic or hydrophobized valuable matter containing material) and at least one second material, wherein the process comprises the following steps:

(A) contacting the dispersion comprising the at least one hydrophobic or hydrophobized material (e.g., the at least one hydrophobic or hydrophobized valuable matter containing material) and the at least one second material with at least one hydrophobic or hydrophobized magnetic particle to provide a dispersion I comprising at least one magnetic agglomerate comprising the at least one hydrophobic or hydrophobized material (e.g., the at least one hydrophobic or hydrophobized valuable matter containing material) and the at least one hydrophobic or hydrophobized magnetic particle;

(B) separating the at least one magnetic agglomerate from the dispersion I of step (A) by subjecting the dispersion I to flotation;

(C) disaggregating the at least one magnetic agglomerate of step (B) to obtain a dispersion II containing the at least one hydrophobic or hydrophobized material (e.g., the at least one hydrophobic or hydrophobized valuable matter containing material) and the at least one hydrophobic or hydrophobized magnetic particle; and (D) separating the at least one hydrophobic or hydrophobized magnetic particle from dispersion II containing the at least one hydrophobic or hydrophobized material (e.g., the at least one hydrophobic or hydrophobized valuable matter containing material) by applying a magnetic field.

DETAILED DESCRIPTION

The present invention relates to a process for the separation of at least one hydrophobic or hydrophobized material from a dispersion comprising said at least one hydrophobic or hydrophobized material and at least one second material, wherein the process comprises the following steps:

(A) contacting the dispersion comprising the at least one hydrophobic or hydrophobized material and the at least one second material with at least one hydrophobic or hydrophobized magnetic particle to provide a dispersion I comprising at least one magnetic agglomerate comprising the at least one hydrophobic or hydrophobized material and the at least one hydrophobic or hydrophobized magnetic particle;

(B) separating the at least one magnetic agglomerate from the dispersion I of step (A) by subjecting the dispersion I to flotation;

(C) disaggregating the at least one magnetic agglomerate of step (B) to obtain a dispersion II containing the at least one hydrophobic or hydrophobized material and the at least one hydrophobic or hydrophobized magnetic particle; and (D) separating the at least one hydrophobic or hydrophobized magnetic particle from dispersion II containing the at least one hydrophobic or hydrophobized material by applying a magnetic field.

The process according to the present invention and its preferred embodiments will be explained in detail in the following.

The at least one hydrophobic or hydrophobized material according to the invention may contain desired or undesired material. Desired material according to the invention contains valuable matter. Undesired material according to the invention may contain e.g. toxic or undesired metals such as chromium.

In one embodiment of the process of the invention, the at least one hydrophobic or hydrophobized material is a hydrophobic or hydrophobized valuable matter containing material and the second material is the undesired material.

In another embodiment of the process of the invention, the at least one hydrophobic or hydrophobized material is the undesired material and the second material is the at least one valuable matter containing material.

In a preferred embodiment of the process of the invention, the at least one hydrophobic or hydrophobized material is a hydrophobic or hydrophobized valuable matter containing material which comprises one or more desired valuable matter, such as metals, in any form and the second material is the undesired material. The at least one valuable matter containing material may comprise sulfidic ore minerals, oxidic ore mineral, carbonate-comprising ore minerals, metals in elemental form, alloys comprising metals, compounds comprising metals and mixtures thereof.

In another preferred embodiment, the at least one valuable matter containing material comprises metals such as Ag, Au, Pt, Pd, Rh, Ru, Ir, Os, Cu, Mo, Ni, Mn, Zn, Pb, Te, Sn, Hg, Re, V, Fe, Co, or mixtures thereof, preferably in the native state or as sulphides, phosphides, selenides, arsenides, tellurides or ore minerals thereof. In a further preferred embodiment, these metals are present in form of alloys such as alloys with other metals such as Fe, Cu, Ni, Pb, Sb, Bi; with each other; and/or compounds containing non-metals such as phosphides, arsenides, sulphides, selenides, tellurides and the like. The alloys of these metals or their compounds with iron or platinum may for example occur in slags obtained after smelting of spent automotive catalysts.

In a preferred embodiment, the at least one valuable matter containing material comprises an FePt alloy.

In a preferred embodiment, the at least one valuable matter containing material comprises Ag, Au, Pt, Pd, Rh, Ru, Ir, Os, Cu, Mo, Ni, Mn, Zn, Pb, Te, Sn, Hg, Re, V, or mixtures thereof; or alloys thereof, preferably with each other and/or with elements like Fe, Ni or Pd.

In a preferred embodiment, the at least one valuable matter containing material comprises Au, Pt, Ir, Pd, Os, Ag, Hg, Rh, Ru or combinations thereof, preferably Au, Pt, Pd or Rh or combinations thereof, and more preferably Pt, Pd or Rh or combinations thereof.

In a preferred embodiment, the at least one valuable matter containing material comprises Ru, Rh, Pd, Os, Ir, Pt or combinations or alloys thereof.

In one preferred embodiment, the at least one valuable matter containing material is present in form of an ore mineral.

In a preferred embodiment, the at least one valuable matter containing material comprises ore minerals, preferably ore minerals such as sufidic ore minerals for example pyrite ($FeS_2$), galena (PbS), braggite (Pt,Pd,Ni)S, argentite ($Ag_2S$) or sphalerite (Zn, Fe)S, oxidic and/or carbonate-comprising ore minerals, for example azurite [$Cu_3(CO_3)_2(OH)_2$] or malachite [$Cu_2[(OH)_2|CO_3]$], rare earth metals comprising ore minerals like bastnaesite (Y, Ce, La)$CO_3F$, monazite (RE)$PO_4$ (RE=rare earth metal) or chrysocolla $(Cu,Al)_2H_2Si_2O_5(OH)_4.nH_2O$.

In one embodiment, the at least one valuable matter is present in form of sulfidic ore minerals such as copper ore minerals comprising covellite CuS, molybdenum(IV) sulfide, chalcopyrite (cupriferous pyrite) $CuFeS_2$, bornite $Cu_5FeS_4$, chalcocite (copper glance) $Cu_2S$ or pentlandite $(Fe,Ni)_9S_8$.

In another preferred embodiment, the at least one valuable matter is present in form of solid solutions of metals such as Pd, Pt, Rh, Au, Ag, Ru, Re in the above mentioned sulfides, and mixtures thereof.

In another preferred embodiment, the at least one valuable matter containing material comprises tellurides and arsenides of metals such as Pd, Pt, Rh, Au, Ag, Ru, Re or other slow-floating precious-metal containing compounds such as Pt—(Pd)—As—S systems like $PtAs_2$ (sperrylite), $Pd_2As$ (palladoarsenide), $Pd_8As_3$ (stillwaterite), PtAsS (platarsite) or other sulfarsenides like (Pt, Ir, Ru)AsS solid solutions; kotulskite PdTe (and its Bi-rich form); merenskyite $PdTe_2$ (as well as its intermediate phases in the merenskykite-michenerite solid solutions); michenerite PdBiTe, Pd-bismuthotelluride $Pd_8Bi_6Te_3$; sopcheite ($Pd_3Ag_4Te_4$); guanglinite ($Pd_3As$); palladium arsenide (Pd—As); palladium antimonide (Pd—Sb); paolovite ($Pd_2Sn$); $Pd_{1.6}As_{1.5}Ni$, moncheite (Pt, Pd)(Bi, Te)$_2$; $PtTe_2$; or PtS (cooperate) and PdS (vysotskite) which may also crystallize from arsenide- or telluride-bearing sulfide melts and thus contain at least some As or Te.

In one preferred embodiment, the at least one valuable matter containing material comprises a valuable matter of platinum group metals (PGM), i.e. Pd, Pt, Rh Os, Ir or Ru, in an amount of from 0.5 to 50 ppm, preferably of 0.5 to 4 ppm and more preferably of about 1 ppm, relative to the dry weight of the material. In a more preferred embodiment, these PGM metals may be present as solid solution in other sulfidic minerals such as pentlandite. The pentlandite content relative to the dry weight of the valuable matter containing material and at least one second material may, for example, be from 0.1 to 2% by weight and preferably from 0.8 to 1.2% by weight.

The at least one second material may be any hydrophilic material. The at least one second material may be the desired or the undesired material. In a preferred embodiment, the at least one second material is the undesired material.

In one embodiment, the undesired material (e.g. the at least one second material) is a hydrophilic metal compound or a hydrophilic semimetal compound. In one embodiment, the undesired material (e.g., the at least one second material) comprises oxidic metal or semimetal compounds, carbonate comprising metal or semimetal compounds, silicate comprising metal or semimetal compounds, sulfidic metal or semimetal compounds, hydroxidic metal or semimetal compounds or mixtures thereof. Suitable oxidic metal or semimetal compounds which may be present as the undesired material (e.g. the at least one second material) according to the invention include, but are not limited to, silicon dioxide ($SiO_2$), silicates, aluminosilicates, such as feldspars, albite ($Na(Si_3Al)O_8$), mica, for example muscovite ($KAl_2[(OH,F)_2AlSi_3O_{10}]$), garnets (Mg, Ca, $Fe^{II})_3(Al, Fe^{III})_2(SiO_4)_3$ and further related minerals and mixtures thereof.

In one embodiment of the process according to the invention, the undesired material (e.g. the at least one second material) is selected from the group consisting of $SiO_2$, CaO, $Al_2O_3$, MgO, $P_2O_3$, $ZrO_2$, $Fe_2O_3$, $Fe_3O_4$, $CeO_2$, $Cr_2O_3$, complex oxide matrices and mixtures thereof.

In a preferred embodiment, the undesired material (e.g. the at least one second material) comprises chromium or chromium-containing compounds or minerals or mixtures thereof.

Accordingly, in a preferred embodiment of the present invention the dispersion comprising the at least one hydrophobic or hydrophobized material and the at least one second material may comprise untreated ore and/or ore mineral mixtures obtained from mines.

In one of the embodiment, a typical ore mixture which can be separated by means of the process of the invention may have the following composition:

(i) about 30% by weight of $SiO_2$ and about 30% by weight of feldspar (e.g. $Na(Si_3Al)O_8$) as an example of a preferred undesired material (e.g. the at least one second material); and about 0.05% by weight of $MoS_2$, balance chromium, iron, titanium and magnesium oxides; and (ii) Pd, Pt and/or Rh, each in a grade of from 0.5 to 50 ppm, from 0.5 to 4 ppm, or about 1 ppm, relative to the whole composition as an example of a preferred desired material (e.g. the at least one valuable matter). Said metals may be present as solid solution in other sulfidic minerals like pentlandite. The pentlandite content relative to the whole mixture to be treated may be 0.1 to 2% by weight, for example 0.8 to 1.2% by weight.

The individual essential and optional steps of the process according to the present invention are explained in detail in the following. Each single step and/or the whole process of the present invention may be conducted continuously or discontinuously, wherein conducting each single step and the whole process continuously is preferred.

Step (A):

Step (A) of the process according to the present invention comprises contacting a dispersion comprising at least one hydrophobic or hydrophobized material and at least one second material with at least one hydrophobic or hydrophobized magnetic particle to provide a dispersion I comprising at least one magnetic agglomerate comprising the at least one hydrophobic or hydrophobized material and the at least one hydrophobic or hydrophobized magnetic particle. The dispersion I obtained in step (A) further comprises the at least one second material. In a preferred embodiment, step (A) of the process according to the present invention comprises contacting a dispersion comprising at least one hydrophobic or hydrophobized valuable matter containing material and at least one second material with at least one hydrophobic or hydrophobized magnetic particle to provide a dispersion I comprising at least one magnetic agglomerate comprising the at least one hydrophobic or hydrophobized valuable matter containing material and the at least one hydrophobic or hydrophobized magnetic particle.

Suitable dispersion mediums for step (A) of the present invention are water or lower alcohols, such as $C_1$-$C_4$-alcohols. A non-flammable solvent, such as water, is preferred.

In a further embodiment of the present invention, the dispersion comprising at least one hydrophobic or hydrophobized material (e.g., at least one hydrophobic or hydrophobized valuable matter containing material) and at least one second material comprises slag, for example smelter slag or furnace slag. These materials are in general known to the skilled artisan. In a preferred embodiment, the slag may be furnace slag resulting from processing concentrates from platinum group metals (PGMs) bearing ores, spent catalyst materials or mixtures thereof.

In a preferred embodiment, the dispersion comprises slag, and preferably furnace slag, which is obtained from smelting processes known to the skilled artisan, for example smelting processes to obtain metals such as Mo, Cu, Ni, Ag, Hg, Au, Pt, Pd, Rh, Ru, Ir, Os or mixtures thereof.

In a preferred embodiment, the dispersion comprising at least one hydrophobic or hydrophobized material (e.g., at least one hydrophobic or hydrophobized valuable matter containing material) and at least one second material comprises furnace slag. Said furnace slag may be obtained as a product, for example an end-product, a by-product and/or as a waste-product of smelting processes.

In a preferred embodiment of the present invention, the dispersion comprising at least one hydrophobic or hydrophobized material (e.g., at least one hydrophobic or hydrophobized valuable matter containing material) and at least one second material comprises smelter slag, wherein preferably the smelter slag is obtained from the mixing layer.

In a preferred embodiment of the process according to the present invention, the dispersion comprising at least one hydrophobic or hydrophobized material (e.g., at least one hydrophobic or hydrophobized valuable matter containing material) and at least one second material comprises artificially prepared slag.

In one embodiment, the dispersion comprising at least one hydrophobic or hydrophobized material (e.g., at least one hydrophobic or hydrophobized valuable matter containing material) and at least one second material comprises furnace slag comprising at least one valuable matter and from 5 to 80% by weight $SiO_2$, from 20 to 50% by weight CaO, from 0 to 60% by weight $Al_2O_3$, from 0 to 10% by weight MgO, from 0 to 10% by weight $P_2O_5$, from 0 to 10% by weight $ZrO_2$, from 0 to 10% by weight $Fe_2O_3$, and optionally other iron oxides, from 0 to 10% by weight $CeO_2$, and optionally other components, wherein the % are based on the total weight of the furnace slag.

In another preferred embodiment, the dispersion comprising at least one hydrophobic or hydrophobized material (e.g., at least one hydrophobic or hydrophobized valuable matter containing material) and at least one second material comprises slag which may contain further components such as lead- and/or iron-containing compounds and/or lead and/or iron in metallic form. In a preferred embodiment, iron containing compounds like magnetite are present in the slag to be separated.

In another preferred embodiment, the dispersion comprising at least one hydrophobic or hydrophobized material (e.g., at least one hydrophobic or hydrophobized valuable matter containing material) and at least one second material comprises slag containing at least one valuable matter in an amount of from 0.01 to 1000 g/t or from 0.01 to 500 g/t slag. Slag materials containing the desired at least one valuable matter in lower or higher amounts are also within the scope of the present invention.

According to a particularly preferred embodiment of the present invention, the dispersion comprising at least one hydrophobic or hydrophobized material (e.g., at least one hydrophobic or hydrophobized valuable matter containing material) and at least one second material comprises slag comprising at least one valuable matter selected from Ag, Au, Pt, Pd, Rh, Ru, Ir, Os, Zn, Pb, Te, Sn, Hg, Re, V or Fe and/or the base metals sulphides of Cu, Mo, Ni and Mn or others in an amount of from 0.01 to 1000 g/t slag.

In a preferred embodiment, the dispersion comprising at least one hydrophobic or hydrophobized material (e.g., at least one hydrophobic or hydrophobized valuable matter containing material) and at least one second material comprises ore-bearing slag and/or wet ore tailings.

In a preferred embodiment of the process of the invention, the dispersion comprising at least one hydrophobic or hydrophobized material (e.g., at least one hydrophobic or hydrophobized valuable matter containing material) and at least one second material in the form of particles having a particles size of from 100 nm to 400 μm. Such particles may be prepared as shown in U.S. Pat. No. 5,051,199. In a preferred embodiment, the particle size is obtained by comminuting, for example by milling. Suitable processes and apparatuses for comminuting are known to those skilled in the art and examples thereof include wet milling in a ball mill. In a preferred embodiment of the process of the present invention, the dispersion comprising at least one hydrophobic or hydrophobized material (e.g., at least one hydrophobic or hydrophobized valuable matter containing material) and the at least one second material is therefore comminuted, preferably milled, to particles having a particles size of from 100 nm to 400 μm before step (A). Analytical methods for determining the particle size are known to the skilled artisan and for example include Laser Diffraction or Dynamic Light Scattering for particle sizes of 100 nm to 10 μm or sieve analysis for particles having particle sizes from about 10 μm to about 400 μm.

In a preferred embodiment of the present invention, at least one milling additive may be added before or during the milling of the at least one hydrophobic or hydrophobized material (e.g., at least one hydrophobic or hydrophobized valuable matter containing material) and the at least one second material. The at least one milling additive is preferably added in an amount of from 5 g/t to 10000 g/t, based on the weight of material to be milled. Examples of suitable milling additives include organic polymers that may be used as clay dispersants. Said polymers may additionally decrease slurry viscosities during milling and thus decrease the energy costs of the milling step, or even increase the grade of the separated valuable matter containing material. Examples of such commercially available polymers include carboxymethylcelluloses, such as carboxymethylcelluloses in neutral or neutralized form. Examples also include the Antiprex product line of BASF SE.

The process according to the present invention comprises contacting the dispersion of step (A) with at least one hydrophobic or hydrophobized magnetic particle so that the at least one hydrophobic or hydrophobized material (e.g., the at least one hydrophobic or hydrophobized valuable matter containing material) and the at least one hydrophobic or hydrophobized magnetic particle become attached to one another and form at least one magnetic agglomerate. The agglomeration between the at least one hydrophobic or hydrophobized material (e.g., the at least one hydrophobic or hydrophobized valuable matter containing material) and the at least one hydrophobic or hydrophobized magnetic particle may generally occur as a result of all attractive forces known to those skilled in the art, for example as a result of hydrophobic interactions and/or magnetic forces. Preferably, essentially only the at least one hydrophobic or hydrophobized material (e.g., the at least one hydrophobic or hydrophobized valuable matter containing material) and the at least one hydrophobic or hydrophobized magnetic particle agglomerate in step (A) while the at least one second material and the at least one hydrophobic or hydrophobized magnetic particle do not or essentially do not agglomerate together.

In a preferred embodiment of the process of the invention, the at least one hydrophobic or hydrophobized material (e.g., the at least one hydrophobic or hydrophobized valuable matter containing material) and the at least one hydrophobic or hydrophobized magnetic particle agglomerate as a result of hydrophobic interactions or due to different surface charges. In one embodiment of the process of the invention, the agglomeration may be at least partly due to the treatment of the at least one material (e.g., the at least one valuable matter containing material) and/or the at least one magnetic particle with a surface-modifying agent. For example, the international publications WO 2009/010422, WO 2009/065802 WO 2010/007075 and WO 2010/007157 disclose surface-modifying agents which selectively couple the at least one valuable matter containing material and the at least one magnetic particle.

In a preferred embodiment of the process according to the present invention, the at least one hydrophobic or hydrophobized material (e.g., the at least one hydrophobic or hydrophobized valuable matter containing material) and the at least one hydrophobic or hydrophobized magnetic particle agglomerate as a result of hydrophobic interactions.

In a preferred embodiment, the at least one hydrophobic or hydrophobized material (e.g., the at least one hydrophobic or hydrophobized valuable matter containing material) has been treated with at least one collector before step (A), in step (A) and/or in step (B) of the process of the present invention.

In a preferred embodiment, the contact angle between the particle comprising the at least one material (e.g. the at least one valuable matter containing material) treated with at least one collector and water against air is >90°. Thus, in a preferred embodiment, the treatment with the collector renders the at least one material (e.g., the at least one valuable matter containing material) hydrophobic.

In one embodiment, the at least one hydrophobic or hydrophobized material (e.g., the at least one hydrophobic or hydrophobized valuable matter containing material) has been treated with at least ionizing collector or non-ionizing collector or mixtures thereof.

In a preferred embodiment, the at least one hydrophobic or hydrophobized material (e.g., the at least one hydrophobic or hydrophobized valuable matter containing material) has been treated with an ionizing collector, i.e. with a cationic or anionic collector.

In one embodiment, the at least one collector is a polymer, for example at least one of the polymers described in WO 2013/038192.

According to a preferred embodiment of the process according to the present invention, the at least one collector is a compound of the general formula (I) or derivative thereof $$[(A)_m(Z)_n]_o \quad (I)$$

wherein each A is independently selected from linear or branched $C_1$-$C_{30}$-alkyl, $C_2$-$C_{30}$-alkenyl $C_1$-$C_{30}$-heteroalkyl, optionally substituted $C_6$-$C_{30}$-aryl, $C_6$-$C_{30}$-cycloalkyl, $C_6$-$C_{30}$-heteroalkyl, $C_6$-$C_{30}$-heterocycloalkyl, $C_6$-$C_{30}$-aralkyl, each of which may be unsubstituted or optionally substituted;

and each Z is independently selected from anionic groups, cationic groups or non-ionic groups;

m is an integer number of 1, 2, 3, 4, 5, 6, 7, 8, 9 or 10;

n is an integer number of 1, 2, 3, 4, 5, 6, 7, 8, 9 or 10; and o is an integer number of 1, 2, 3, 4, 5, 6, 7, 8, 9 or 10 to 100.

It is understood that formula (I) includes all possible combinations of how each A and each Z may be attached to one another. This includes any linear attachment, such as in -A-A-Z-Z-, A-Z-A-Z-, -Z-A-Z-A- and the like; branched attachments, such as in

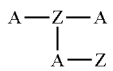

and the like; and circular attachments such as in

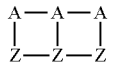

and the like. The skilled person is able to identify suitable attachment sites, such as substitution sites, in substituent A and Z that allow the attachment.

Furthermore, particularly preferred attachment sites are indicated in the respective definition of substituent Z.

In a particularly preferred embodiment, A is a linear or branched $C_1$-$C_{20}$-alkyl, and preferably a linear $C_4$-alkyl or $C_8$-alkyl.

In a further preferred embodiment, A is preferably a branched $C_1$-$C_{20}$-alkyl, particularly preferably a branched $C_6$-$C_{14}$-alkyl, wherein preferably at least one branch, preferably a branch having 1 to 6 carbon atoms, is attached in 2-position, such as in 2-ethylhexyl and/or 2-propylheptyl. Corresponding compounds being substituted in 2-position are, for example, obtained using the Guerbet reaction that is known to the skilled artisan as one reaction step.

In a preferred embodiment, Z is selected as an anionic group. Non-limiting examples of anionic groups are

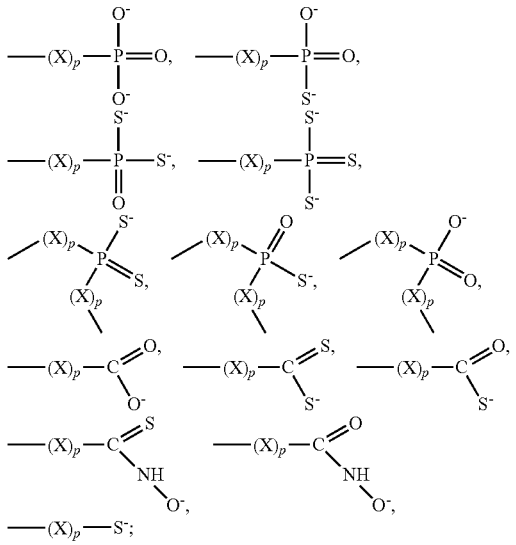

wherein each X is independently selected from the group consisting of O, S, NH, $CH_2$; and each p is independently selected from 0, 1 or 2.

In a preferred embodiment, the anionic group is present as a salt with at least one cation wherein preferably the at least one cationic counter ion is selected from the group consisting of hydrogen, $N(R^1)_4^+$; wherein each $R^1$ is independently selected from hydrogen, $C_1$-$C_8$-alkyl, hydroxysubstituted $C_1$-$C_8$-alkyl or $C_1$-$C_8$-heteroalkyl, preferably HO—$CH_2CH_2$— or HO—$CH_2CH_2$—O—$CH_2CH_2$—; alkali- or earth alkali metals, preferably sodium or potassium; or combinations thereof.

The negatively charged anionic groups may of course also be present in a protonated form, depending, for example, on the pH of the aqueous environment. For example, the —$(X)_p$—$S^-$ anion group may be present as a —$(X)_p$—SH neutral group.

In another preferred embodiment, Z is selected as a cationic group. Non-limiting examples of cationic groups include, but are not limited to.

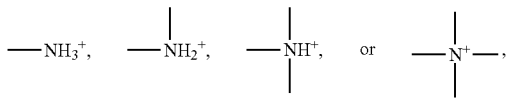

The cationic group may of course also be present in a deprotonated form, depending, for example, on the pH. For instance, —$NH_3^+$ may also be present as —$NH_2$.

In another preferred embodiment, Z is selected as a non-ionic group. Examples of non-ionic groups include, but are not limited to, —$X_A$—,

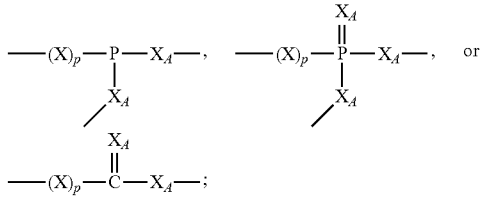

wherein each X is defined as indicated above and each $X_A$ is independently O or S.

In a preferred embodiment, the at least one collector is a compound of formula (IA) or derivative thereof $$A\text{-}Z_1\text{-}A \qquad (IA)$$

wherein each A is selected as described above and wherein $Z_1$ is selected from the group consisting of

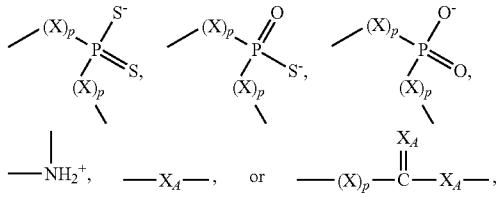

wherein X, $X_A$ and p are defined as described above.

In another preferred embodiment, the at least one collector is a compound of formula (IB) or derivative thereof $$A\text{-}Z_1\text{-}A\text{-}Z_2 \qquad (IB)$$

wherein A and $Z_1$ are defined as described above and wherein $Z_2$ is selected from the group consisting of

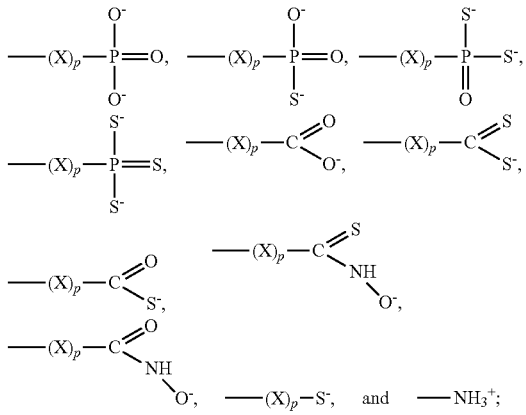

and wherein X and p are as defined above.

In yet another preferred embodiment, the at least one collector is a compound of formula (IC) or derivative thereof

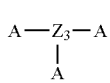

(IC)

wherein A is selected as defined above and wherein $Z_3$ is selected from the group consisting of

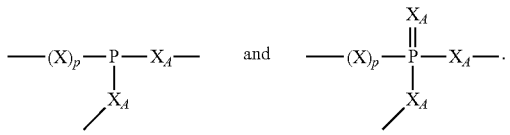

In yet another preferred embodiment, the at least one collector is a compound of formula (ID) or formula (IE),

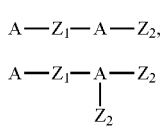

(ID)

(IE)

wherein A, $Z_1$, and $Z_2$ are defined as described above.

In yet another embodiment, the at least one collector is a compound of formula (IF) or (IG) or derivatives thereof

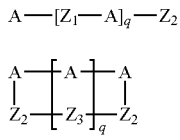

(IF)

(IG)

wherein q is an integer of 1, 2, 3, 4 or 5 to 100 and A, $Z_1$, $Z_2$ or $Z_3$ are defined as described above.

In a further preferred embodiment, the at least one collector is selected from (i) xanthates, preferably xanthates of formula (IH) or (IJ) or derivatives thereof

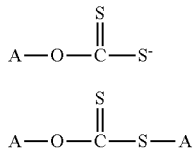

(IH)

(IJ)

(ii) dithiophosphates, preferably dithiophosphates of formula (IK) or derivatives thereof

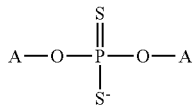

(IK)

(iii) dithiophosphinates, preferably dialkyldithiophosphinates of formula (IL) or derivatives thereof

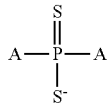

(IL)

(iv) dialkyldithiocarbamates, preferably dialkyldithiocarbamates of formula (IM) or derivatives thereof

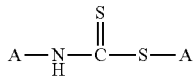

(IM)

or (v) alkyltrithiocarbamates preferably alkyltrithiocarbamates of formula (IN) or derivatives thereof

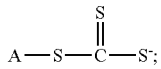

(IN)

or mixtures thereof, wherein each A is defined as described above. In a preferred embodiment, each A is independently selected from a group consisting of a linear or branched and preferably linear $C_6$-$C_{20}$-alkyl, more preferably n-octyl; or a branched $C_6$-$C_{14}$-alkyl, wherein the branch is preferably located in 2-position, for example 2-ethylhexyl and/or 2-propylheptyl.

In an especially preferred embodiment, the at least one collector is selected from the group consisting of sodium- or potassium-n-octylxanthate, sodium- or potassium-butylxanthate, sodium- or potassium-di-n-octyldithiophosphinate, sodium- or potassium-di-n-octyldithiophosphate, sodium- or potassium-di-n-octyldithiocarbamates, sodium- or potassium-ethyl-hexyl-xanthate and mixtures thereof.

In a particularly preferred embodiment, the at least one collector is selected from the group consisting of potassium-n-octyl xanthate (1:1 salt of carbonodithionic acid O-ocytyl ester) or potassium-di-n-octyldithiophosphinate or mixtures thereof.

In a preferred embodiment, preferred collectors for valuable matter containing material wherein the at least one valuable matter is a noble metal, such as Au, Pd, Rh, etc., are monothiols, dithiols and trithiols, or 8-hydroxyquinolines and preferably, the monothiols, dithiols and trithiols, or 8-hydroxyquinolines as described in EP 1 200 408.

In another preferred embodiment, preferred collectors for valuable matter containing material wherein the at least one valuable matter is a metal sulfide, such as $Cu_2S$, $MoS_2$, $FeS_2$ etc., are monothiols, dithiols and trithiols, xanthates or dithiophosphates.

In a preferred embodiment, the at least one collector is used in an amount which is sufficient to achieve the desired effect. In a preferred embodiment, the at least one collector is added in an amount of from about 0.0001 to about 1% by weight and preferably from about 0.001 to about 0.1% by weight in each case based on the weight of total dry solid content.

In general, the at least one hydrophobic or hydrophobized magnetic particle in step (A) of the process according to the present invention may be any magnetic particle.

In a preferred embodiment, the at least one hydrophobic or hydrophobized magnetic particle is selected from the group consisting of magnetic metals, preferably irons, cobalt, nickel and mixtures thereof; ferromagnetic alloys of magnetic metals, for example NdFeB, SmCo and mixtures thereof; magnetic iron oxides, for example magnetite, magnetic hematite, hexagonal ferrites; cubic ferrites of the general formula (II)

$$M^{2+}_{x}Fe^{2+}_{1-x}Fe^{3+}_{2}O_4 \quad \text{(II)}$$

where

M is selected from Co, Ni, Mn, Zn and mixtures thereof and x is ≤1;

and mixtures thereof.

In a particularly preferred embodiment, the at least one hydrophobic or hydrophobized magnetic particle is magnetite. Magnetite is known to the skilled artisan and is commercially available, e.g. as magnetic pigment 345 (BASF SE).

The at least one hydrophobic or hydrophobized magnetic particle that is used in accordance with the present invention has in general an average diameter that enables this particle to efficiently agglomerate with the at least one hydrophobic or hydrophobized material (e.g., the at least one hydrophobic or hydrophobized valuable matter containing material). In a preferred embodiment, the magnetic particle has a $d_{80}$ of from 1 nm to 10 mm, and preferably of from 0.1 μm to 100 μm. The wording "$d_{80}$" is known the skilled artisan and means that 80% by weight of the corresponding particles have a diameter that is smaller than the mentioned value. The particle size of the magnetite can be reduced prior use by grinding or milling. Methods for analyzing the diameter of the magnetic particles or other particles that are used or treated according to the present invention are known to the skilled artisan. Such methods for example include Laser Diffraction Measurement, in particular Laser Diffraction Measurement using a Mastersizer 2000 with software version 5.12G, wherein the sample is dispersed in an aqueous solution of $Na_4P_2O_7$.

In general, the amount of at least one hydrophobic or hydrophobized magnetic particle to be applied in the process of the present invention can be determined by a person having ordinary skill in the art in a way that advantageously the whole amount of the at least one hydrophobic or hydrophobized material (e.g., the at least one hydrophobic or hydrophobized valuable matter containing material) can be separated by agglomerating with the at least one hydrophobic or hydrophobized magnetic particle. In a preferred embodiment of the process according to the present invention, the at least one hydrophobic or hydrophobized magnetic particle is added in an amount of from 0.01 to 20% by weight, preferably from 0.1 to 10% by weight, particularly preferably from 0.5 to 4.5% by weight, based on the weight of the dry at least one hydrophobic or hydrophobized material (e.g., the at least one hydrophobic or hydrophobized valuable matter containing material) and the at least one second material.

In one embodiment of the invention, the magnetic particle is a hydrophobic magnetic particle. In another embodiment of the invention, the at least one magnetic particle is hydrophobized on its surface, i.e. is a hydrophobized magnetic particle. In a preferred embodiment, the at least one magnetic particle has been hydrophobized by treatment with a hydrophobizing agent, wherein preferably the magnetic particle treated with the hydrophobizing agent has a contact angle between the particle surface and water against air of preferably more than 30°, more preferably more than 60°, even more preferably more than 90° and particularly preferably more than 140°.

In general, the hydrophobizing agent may be any agent that will render the surface of the magnetic particle more hydrophobic than the surface of the magnetic particle before the treatment.

In one embodiment, the hydrophobizing agent for hydrophobizing the at least one magnetic particle is a compound of the general formula (III) or derivative thereof $$[(B)_e—(Y)_f]_g \quad \text{(III)},$$

wherein each B is independently selected from among linear or branched $C_1$-$C_{30}$-alkyl, $C_1$-$C_{30}$-heteroalkyl, optionally substituted $C_6$-$C_{30}$-aryl, optionally substituted $C_6$-$C_{30}$-heteroalkyl, $C_6$-$C_{30}$-aralkyl;

and each Y is independently selected as a group by means of which the compound of the general formula (III) binds to the at least one magnetic particle;

each e is the integer 1, 2, 3, 4, 5, 6, 7, 8, 9 or 10;

each f is the integer 1, 2, 3, 4, 5, 6, 7, 8, 9 or 10; and each g is the integer 1, 2, 3, 4, 5, 6, 7, 8, 9 or 10 to 100.

In a particularly preferred embodiment, B is a linear or branched $C_6$-$C_{18}$-alkyl, preferably linear $C_8$-$C_{12}$-alkyl and very particularly preferably a linear $C_{12}$-alkyl.

In a further particularly preferred embodiment, Y is selected from the group consisting of $—(X)_p—Si(R^2)_3$, $—(X)_p—SiH(R^2)_2$, $—(X)_pSiH_2R^2$, wherein each $R^2$ is independently selected from F, Cl, Br, I or OH; and anionic groups such as

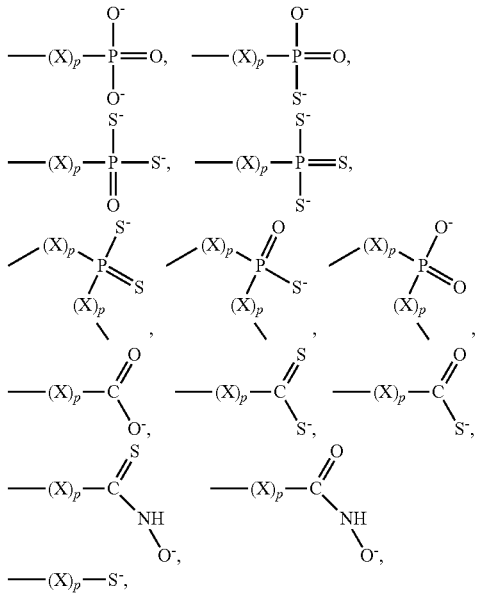

wherein each X is independently O, S, NH, or $CH_2$ and p is 0, 1 or 2.

Very particularly preferred hydrophobizing agents of the general formula (III) are silicon-based oils or siloxanes resulting from in-situ hydrolysis of dodecyl- or other alkyltrichlorosilanes or alkyltrialkoxysilanes; phosphonic acids, for example octylphosphonic acid; carboxylic acids; for example lauric acid, oleic acid or stearic acid; partly polymerized siloxanes (also known as silicon oils), or mixtures thereof.

In a preferred embodiment, the hydrophobizing agent is a compound as disclosed in WO 2012/140065.

Further preferred hydrophobizing agents are mono-, oligo- or polysiloxanes with free OH groups, such as the compounds of formula (IIIa), (IIIb) and (IIIc) or derivatives thereof, (IIIa)

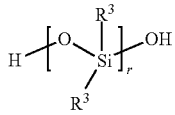

-continued (IIIb)

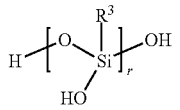

(IIIc)

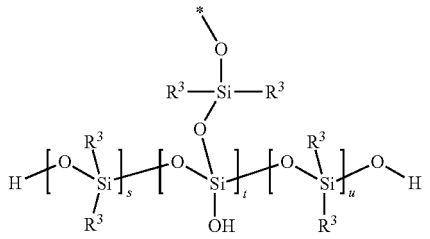

wherein each r, s, t, and u is independently an integer from 1 to 100, and each $R^3$ is independently a straight or branched $C_1$-$C_{12}$ alkyl group.

In formula (IIIc),* denotes a bonding to further moieties comprising —$SiOR_4$ and wherein $R^4$ is selected from hydrogen, linear or branched, optionally substituted $C_1$-$C_{30}$-alkyl, linear or branched, optionally substituted $C_2$-$C_{30}$-alkenyl, linear or branched, optionally substituted $C_2$-$C_{30}$-alkynyl, optionally substituted $C_3$-$C_{20}$-cycloalkyl, optionally substituted $C_3$-$C_{20}$-cycloalkenyl, optionally substituted $C_1$-$C_{20}$-heteroalkyl, optionally substituted $C_5$-$C_{22}$-aryl, optionally substituted $C_6$-$C_{23}$-alkylaryl, optionally substituted $C_6$-$C_{23}$-arylalkyl or optionally substituted $C_5$-$C_{22}$-heteroaryl.

In a preferred embodiment, the hydrophobizing agents of formula (IIIa), (IIIb) or (IIIc) have a molecular weight from about 250 to about 200000 g/mol, preferably from about 250 to about 20000 g/mol and particularly preferably from about 300 to about 5000 g/mol.

According to a preferred embodiment, the hydrophobizing agent is a compound of the general formulas (IV), (IVa), (IVb), (IVc) or derivatives thereof (IV)

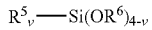

(IVa)

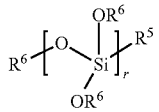

(IVb)

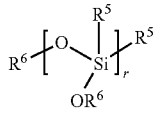

(IVc)

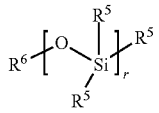

wherein each $R^5$ is independently selected from hydrogen, linear or branched, optionally substituted $C_1$-$C_{30}$-alkyl, linear or branched, optionally substituted $C_2$-$C_{30}$-alkenyl, linear or branched, optionally substituted $C_2$-$C_{30}$-alkynyl, optionally substituted $C_3$-$C_{20}$-cycloalkyl, optionally substituted $C_3$-$C_{20}$-cycloalkenyl, optionally substituted $C_1$-$C_{20}$-heteroalkyl, optionally substituted $C_5$-$C_{22}$-aryl, optionally substituted $C_6$-$C_{23}$-alkylaryl, optionally substituted $C_6$-$C_{23}$-arylalkyl or optionally substituted $C_5$-$C_{22}$-heteroaryl;

each $R^6$ is independently selected from hydrogen, linear or branched, optionally substituted $C_1$-$C_{30}$-alkyl, linear or branched, optionally substituted $C_2$-$C_{30}$-alkenyl, linear or branched, optionally substituted $C_2$-$C_{30}$-alkynyl, optionally substituted $C_3$-$C_{20}$-cycloalkyl, optionally substituted $C_3$-$C_{20}$-cycloalkenyl, optionally substituted $C_1$-$C_{20}$-heteroalkyl, optionally substituted $C_5$-$C_{22}$-aryl, optionally substituted $C_6$-$C_{23}$-alkylaryl, optionally substituted $C_6$-$C_{23}$-arylalkyl or optionally substituted $C_5$-$C_{22}$-heteroaryl, and the integer r is as described above and v is the integer 1, 2 or 3.

Preference is given to the radicals $R^5$ each being, independently of one another, linear or branched, optionally substituted $C_1$-$C_{30}$-alkyl, particularly preferably $C_1$-$C_{20}$-alkyl, very particularly preferably $C_4$-$C_{12}$-alkyl. In a preferred embodiment, $R^5$ is linear or branched, unsubstituted $C_1$-$C_{30}$-alkyl, particularly preferably $C_1$-$C_{20}$-alkyl or very particularly preferably $C_4$-$C_{12}$-alkyl. Examples of linear or branched $C_4$-$C_{12}$-alkyl radicals are butyl, in particular, n-butyl, isobutyl, tert-butyl; pentyl, in particular n-pentyl, isopentyl, tert-pentyl; hexyl, in particular n-hexyl, isohexyl, tert-hexyl, heptyl; in particular n-heptyl, isoheptyl, tert-heptyl; octyl in particular n-octyl, isooctyl, tert-octyl; nonyl, in particular n-nonyl, isononyl, tert-nonyl, decyl, in particular n-decyl, isodecyl, tert-decyl, undecyl, in particular n-undecyl, isoundecyl, tert-undecyl, or dodecyl, in particular n-dodecyl; isododecyl or tert-dodecyl.

Further preference is given to the radicals $R^5$ each being, independently of one another, linear or branched, optionally substituted $C_2$-$C_{30}$-alkenyl, particularly preferably $C_2$-$C_{20}$-alkenyl, very particularly preferably or $C_2$-$C_{12}$-alkenyl. Examples of alkenyl radicals which are particularly preferred according to the invention are ethenyl (vinyl), propenyl, in particular n-propenyl, isopropenyl, butenyl, in particular n-butenyl, isobutenyl, tert-butenyl, pentenyl, in particular n-pentenyl, isopentenyl, tert-pentenyl, hexenyl, in particular n-hexenyl, isohexenyl, tert-hexenyl, heptenyl, in particular n-heptenyl, isoheptenyl, tert-heptenyl, octenyl, in particular n-octenyl, isooctenyl, tert-octenyl, nonenyl, in particular n-nonenyl, isononenyl, tert-nonenyl, decenyl, in particular n-decenyl, isodecenyl, tert-decenyl, undecenyl, in particular n-undecenyl, isoundecenyl, tert-undecenyl, or dodecenyl, in particular n-dodecenyl, isododecenyl and tert-dodecenyl.

Further preference is given to the radicals $R^5$ each being, independently of one another, linear or branched, optionally substituted $C_2$-$C_{30}$-alkynyl, particularly preferably $C_2$-$C_{20}$-alkynyl, very particularly preferably $C_2$-$C_{12}$-alkynyl. Examples of alkynyl radicals which are particularly preferred according to the invention are ethynyl, propynyl, in particular n-propynyl, isopropynyl, butynyl, in particular n-butynyl, isobutynyl, tert-butynyl, pentynyl, in particular n-pentynyl, iso-pentynyl, tert-pentynyl, hexynyl, in particular n-hexynyl, isohexynyl, tert-hexynyl, heptynyl, in particular n-heptynyl, isoheptynyl, tert-heptynyl, octynyl, in particular n-octynyl, isooctynyl, tert-octynyl, nonynyl, in particular n-nonynyl, isononynyl, tert-nonynyl, decynyl, in particular n-decynyl, iso-decynyl, tert-decynyl, undecynyl, in particular n-undecynyl, isoundecynyl, tert-undecynyl, or dodecynyl, in particular n-dodecynyl, isododecynyl and tert-dodecynyl.

Further preference is given to the radicals $R^5$ each being, independently of one another, optionally substituted $C_3$-$C_{20}$-cycloalkyl, particularly preferably $C_3$-$C_{12}$-cycloalkyl, very particularly preferably $C_3$-$C_6$-cycloalkyl, such as cyclopropyl, cyclobutyl, cyclopentyl or cyclohexyl.

Further preference is given to the radicals $R^5$ each being, independently of one another, optionally substituted $C_3$-$C_{20}$-cycloalkenyl, particularly preferably $C_3$-$C_{12}$-cycloalkenyl, very particularly preferably $C_3$-$C_6$-cycloalkenyl such as cyclopropenyl, cyclobutenyl, cyclopentenyl or cyclohexenyl.

Further preference is given to the radicals $R^5$ each being, independently of one another, optionally substituted $C_1$-$C_{20}$-heteroalkyl, particularly preferably $C_1$-$C_{12}$-heteroalkyl. The heteroalkyl radicals present according to the invention are derived from the abovementioned alkyl radicals, with at least one carbon atom being replaced by a heteroatom selected from among N, O, P and S.

Further preference is given to the radicals $R^5$ each being, independently of one another, optionally substituted $C_5$-$C_{22}$-aryl, particularly preferably $C_5$-$C_{12}$-aryl. Examples of aryl radicals which are preferred according to the invention are phenyl, naphthyl or biaryls.

Further preference is given to the radicals $R^5$ each being, independently of one another, optionally substituted $C_6$-$C_{23}$-alkylaryl, particularly preferably $C_6$-$C_{13}$-alkylaryl. An example of an alklaryl radical which is preferred according to the invention is benzyl.

Further preference is given to the radicals $R^5$ each being, independently of one another, optionally substituted $C_6$-$C_{23}$-arylalkyl, particularly preferably $C_6$-$C_{13}$-arylalkyl. Examples of arylalkyl radicals which are preferred according to the invention are tolyl, xylyl, propylbenzyl or hexylbenzyl.

Further preference is given to the radicals $R^5$ each being, independently of one another, optionally substituted $C_5$-$C_{22}$-heteroaryl, particularly preferably $C_5$-$C_{12}$-heteroaryl.

The abovementioned radicals $R^5$ can optionally be substituted. Suitable substituents are, for example, selected from among amino, amido, imido, hydroxyl, ether, aldehyde, keto, carboxylic acid, thiol, thioether, hydroxamate and carbamate groups. The abovementioned radicals $R^5$ can be mono- or poly-substituted. In the case of multiple substitutions, one substituent group can be present a plurality of times or various functional groups are simultaneously present. The radicals mentioned for $R^5$ can also be monosubstituted or polysubstituted by the abovementioned alkyl, alkenyl, alkynyl, aryl, alkylaryl, arylalkyl, heteroalkyl or heteroaryl radicals.

Very particularly preferred radicals $R^5$ are octyl, in particular n-octyl; hexyl, in particular n-hexyl; and/or butyl, in particular n-butyl; decyl, in particular n-decyl; or dodecyl, in particular n-dodecyl.

Preference is given to the radicals $R^6$ each being, independently of one another, hydrogen, linear or branched, optionally substituted $C_1$-$C_{30}$-alkyl, particularly preferably $C_1$-$C_{20}$-alkyl, very particularly preferably $C_1$-$C_{12}$-alkyl. In a preferred embodiment, $R^6$ is linear or branched, unsubstituted $C_1$-$C_{30}$-alkyl, particularly preferably $C_1$-$C_{20}$-alkyl, or very particularly preferably $C_1$-$C_{12}$-alkyl. Examples of linear or branched $C_1$-$C_{12}$-alkyl radicals are methyl, ethyl, propyl, in particular n-propyl, isopropyl, butyl, in particular n-butyl, isobutyl, tert-butyl, pentyl, in particular n-pentyl, isopentyl, tert-pentyl, hexyl, in particular n-hexyl, isohexyl, tert-hexyl, heptyl, in particular n-heptyl, isoheptyl, tert-heptyl, octyl, in particular n-octyl, isooctyl, tert-octyl, nonyl, in particular n-nonyl, isononyl, tert-nonyl, decyl, in particular n-decyl, isodecyl, tert-decyl, undecyl, in particular n-undecyl, isoundecyl, tert-undecyl, or dodecyl, in particular n-dodecyl, isododecyl or tert-dodecyl.

Further preference is given to the radicals $R^6$ each being, independently of one another, linear or branched, optionally substituted $C_2$-$C_{30}$-alkenyl, particularly preferably $C_2$-$C_{20}$-alkenyl and very particularly preferably $C_2$-$C_{12}$-alkenyl. Examples of alkynyl radicals which are particularly preferred according to the invention are ethenyl (vinyl), propenyl, in particular n-propenyl, isopropenyl, butenyl, in particular n-butenyl, isobutenyl, tert-butenyl, pentenyl, in particular n-pentenyl, isopentenyl, tert-pentenyl, hexenyl, in particular n-hexenyl, isohexenyl, tert-hexenyl, heptenyl, in particular n-heptenyl, isoheptenyl, tert-heptenyl, octenyl, in particular n-octenyl, isooctenyl, tert-octenyl, nonenyl, in particular n-nonenyl, isononenyl, tert-nonenyl, decenyl, in particular n-decenyl, isodecenyl, tert-decenyl, undecenyl, in particular n-undecenyl, isoundecenyl, tert-undecenyl, or dodecenyl, in particular n-dodecenyl, isododecenyl or tert-dodecenyl.

Further preference is given to the radicals $R^6$ each being, independently of one another, linear or branched, optionally substituted $C_2$-$C_{30}$-alkynyl, particularly preferably $C_2$-$C_{20}$-alkynyl or very particularly preferably $C_2$-$C_{12}$-alkynyl. Examples of alkynyl radicals which are particularly preferred according to the invention are ethynyl, propynyl, in particular n-propynyl, isopropynyl, butynyl, in particular n-butynyl, isobutynyl, tert-butynyl, pentynyl, in particular n-pentynyl, isopentynyl, tert-pentynyl, hexynyl, in particular n-hexynyl, isohexynyl, tert-hexynyl, heptynyl, in particular n-heptynyl, isoheptynyl, tert-heptynyl, octynyl, in particular n-octynyl, isooctynyl, tert-octynyl, nonynyl, in particular n-nonynyl, isononynyl, tert-nonynyl, decynyl, in particular n-decynyl, iso-decynyl, tert-decynyl, undecynyl, in particular n-undecynyl, isoundecynyl, tert-undecynyl, or dodecynyl, in particular n-dodecynyl, isododecynyl or tert-dodecynyl.

Further preference is given to the radicals $R^6$ each being, independently of one another, optionally substituted $C_3$-$C_{20}$-cycloalkyl, particularly preferably $C_3$-$C_{12}$-cycloalkyl and particularly preferably $C_3$-$C_6$-cycloalkyl, for example cyclopropyl, cyclobutyl, cyclopentyl or cyclohexyl.

Further preference is given to the radicals $R^6$ each being, independently of one another, optionally substituted $C_3$-$C_{20}$-cycloalkenyl, particularly preferably $C_3$-$C_{12}$-cycloalkenyl and very particularly preferably $C_3$-$C_6$-cycloalkenyl, for example cyclopropenyl, cyclobutenyl, cyclopentenyl or cyclohexenyl.

Further preference is given to the radicals $R^6$ each being, independently of one another, optionally substituted $C_1$-$C_{20}$-heteroalkyl, particularly preferably $C_4$-$C_{12}$-heteroalkyl. The heteroalkyl radicals which are present according to the invention are derived from the abovementioned alkyl radicals, with at least one carbon atom being replaced by a heteroatom selected from among N, O, P and S.

Further preference is given to the radicals $R^6$ each being, independently of one another, optionally substituted $C_5$-$C_{22}$-aryl, particularly preferably $C_5$-$C_{12}$-aryl. Examples of aryl radicals which are preferred according to the invention are phenyl, naphthyl or biaryls.

Further preference is given to the radicals $R^6$ each being, independently of one another, optionally substituted $C_6$-$C_{23}$-alkylaryl, particularly preferably $C_6$-$C_{13}$-alkylaryl. An example of an alkylaryl radical which is preferred according to the invention is benzyl.

Further preference is given to the radicals $R^6$ each being, independently of one another, optionally substituted $C_6$-$C_{23}$-arylalkyl and particularly preferably $C_6$-$C_{13}$-arylalkyl. Examples of arylalkyl radicals which are preferred according to the invention are tolyl, xylyl, propylbenzyl or hexylbenzyl.

Further preference is given to the radicals $R^6$ each being, independently of one another, optionally substituted $C_5$-$C_{22}$-heteroaryl and particularly preferably $C_5$-$C_{12}$-heteroaryl.

The abovementioned radicals $R^6$ may optionally be substituted. Suitable substituents are, for example, selected from among amino, amido, imido, hydroxy, ether, aldehyde, keto, carboxylic acid, thiol, thioether, hydroxamate and carbamate groups. The abovementioned radicals $R^6$ can be mono- or poly substituted. In the case of multiple substitutions, one substituent can be present a plurality of times or various functional groups are simultaneously present. The radicals mentioned for $R^6$ can also be monosubstituted or polysubstituted by the abovementioned alkyl, alkenyl, alkynyl, aryl, alkylaryl, arylalkyl, heteroalkyl or heteroaryl radicals.

In another preferred embodiment, the at least one hydrophobizing agent is selected from the group consisting of $(NaO)(CH_3)Si(OH)_2$, $(NaO)(C_2H_5)Si(OH)_2$, $(NaO)(C_5H_{11})Si(OH)_2$, $(NaO)(C_8H_{17})Si(OH)_2$, $(KO)(CH_3)Si(OH)_2$, $(KO)(C_2H_5)Si(OH)_2$, $(KO)(C_5H_{11})Si(OH)_2$, $(KO)(C_8H_{17})Si(OH)_2$, $(NH_4O)(CH_3)Si(OH)_2$, $(NH_4O)(C_2H_5)Si(OH)_2$, $(NH_4O)(C_5H_{11})Si(OH)_2$, $(NH_4O)(C_8H_{17})Si(OH)_2$, $(NaO)_2(CH_3)Si(OH)$, $(NaO)_2(C_2H_5)Si(OH)$, $(NaO)_2(C_5H_{11})Si(OH)$, $(NaO)_2(C_8H_{17})Si(OH)$, $(KO)_2(CH_3)Si(OH)$, $(KO)_2(C_2H_5)Si(OH)$, $(KO)_2(C_5H_{11})Si(OH)$, $(KO)_2(C_8H_{17})Si(OH)$, $(NH_4O)_2(CH_3)Si(OH)$, $(NH_4O)_2(C_2H_5)Si(OH)$, $(NH_4O)_2(C_5H_{11})Si(OH)$, $(NH_4O)_2(C_8H_{17})Si(OH)$, $(NaO)_3(CH_3)Si$, $(NaO)_3(C_2H_5)Si$, $(NaO)_3(C_5H_{11})Si$, $(NaO)_3(C_8H_{17})Si$, $(KO)_3(CH_3)Si$, $(KO)_3(C_2H_5)Si$, $(KO)_3(C_5H_{11})Si$, $(KO)_3(C_8H_{17})Si$, $(NH_4O)_3(CH_3)Si$, $(NH_4O)_3(C_2H_5)Si$, $(NH_4O)_3(C_5H_{11})Si$, $(NH_4O)_3(C_8H_{17})Si$, $(NaO)(CH_3)_2Si(OH)$, $(NaO)(C_2H_5)_2Si(OH)$, $(KO)(CH_3)_2Si(OH)$, $(KO)(C_2H_5)_2Si(OH)$, $(NaO)_2(CH_3)_2Si$, $(NaO)_2(C_2H_5)_2Si$, $(KO)_2(CH_3)_2Si$, $(KO)_2(C_2H_5)_2Si$, $Ca^{2+}[(O^-)(CH_3)Si(OH)_2]_2$, $Ca^{2+}[(O)(C_2H_5)Si(OH)_2]_2$, $Ca^{2+}[(O^-)(C_5H_{11})Si(OH)_2]_2$, $Ca^{2+}[(O)(C_8H_{17})Si(OH)_2]_2$, $Ca^{2+}[(O)(CH_3)_2Si(OH)]_2$, $Ca^{2+}[(O)(C_2H_5)_2Si(OH)]_2$, $Ca^{2+}[(O^-)_2(CH_3)Si(OH)]$, $Ca^{2+}[(O^-)_2(C_2H_5)Si(OH)]$, $Ca^{2+}[(O^-)_2(C_5H_{11})Si(OH)]$, $Ca^{2+}[(O^-)_2(C_8H_{17})Si(OH)]$, $Ca^{2+}[(O^-)_2(CH_3)_2Si]$, $Ca^{2+}[(O^-)_2(C_2H_5)_2Si]$ and combinations thereof.

In one embodiment, the at least one hydrophobizing agent is added to the dispersion in step (A).

In another preferred embodiment, the at least one magnetic particle has been pre-treated with the at least one hydrophobizing agent before the contacting of the dispersion in step (A).

In one embodiment, the at least one hydrophobizing agent or mixtures thereof may polymerize before or during contacting the magnetic particle.

In another particularly preferred embodiment, the at least one hydrophobizing agent is sodium or potassium methylsiliconate.

In another particularly preferred embodiment, the at least one hydrophobized magnetic particle is a magnetite particle that has been treated with a hydrophobizing agent and preferably with the hydrophobizing agent sodium or potassium methylsiliconate.

In a preferred embodiment, the at least one hydrophobizing agent is present as a coating on the surface of the magnetic particles in an amount, based on the total weight of the hydrophobized magnetic particle, of from 0.01 to 10% by weight, preferably from 0.1 to 5% by weight.

According to the present invention, the at least one magnetic particle may be predispersed in a dispersion medium. Preferably, the amount of dispersion medium for predispersing the magnetic particles is generally selected so that a slurry or dispersion is obtained which is readily stirrable and/or conveyable. In a preferred embodiment, the slurry or dispersion comprises between 10 and 60% by weight magnetic particles.

According to the invention, the dispersion of the magnetic particles can be produced by all methods known to those skilled in the art. In a preferred embodiment, the magnetic particles to be dispersed and the appropriate amount of dispersion medium or mixture of dispersion media are combined in a suitable reactor, and stirred by means of devices known to those skilled in the art. For example, such a device is a mechanical propeller stirrer. The stirring may occur at a temperature of from about 1 to about 80° C. and preferably at ambient temperature.

Step (A) of the process of the invention may be carried out at a temperature of from 1 to 80° C., preferably from 20 to 40° C. and particularly preferably at ambient temperature.

The contacting according to step (A) of the process according to the present invention may be conducted in any apparatus known to the skilled artisan. For example, the dispersion I and the at least one hydrophobic or hydrophobized magnetic particle, optionally together with at least one collector and/or the at least one hydrophobizing agent, are combined and mixed in the appropriate amounts in suitable mixing apparatuses that are known to those skilled in the art, such as mills including ball mills.

In a preferred embodiment, dispersion I in step (A) provides a solid content of from 1 to 60% by weight, preferably from 10 to 60% by weight and particularly preferably from 20 to 45% by weight, based on the whole amount of solids that have to be dispersed.

In another preferred embodiment, the at least one hydrophobic or hydrophobized material (e.g., the at least one hydrophobic or hydrophobized valuable matter containing material) and the at least one second material is comminuted, for example by milling as described above, to particles having a particles size of from about 100 nm to about 400 μm before step (A).

According to the present invention, the amount of dispersion medium in step (A) and/or step (C) can generally be selected so that a dispersion is obtained which is readily stirrable and/or conveyable.

After performing step (A) of the process according to the present invention, a dispersion I may be obtained that comprises in addition to the at least one agglomerate comprising the at least one hydrophobic or hydrophobized material (e.g., the at least one hydrophobic or hydrophobized valuable matter containing material) and the at least one hydrophobic or hydrophobized magnetic particle, and the at least one second material, further components such as an at least one collector and/or hydrophobizing agent, wherein the at least one collector and/or hydrophobizing agent is at least partly located between the at least one hydrophobic or hydrophobized material (e.g., the at least one hydrophobic or hydrophobized valuable matter containing material) and the at least one hydrophobic or hydrophobized magnetic particle.

In a preferred embodiment, the amount of dispersion medium that needs to be present in step (A) of the process according to the present invention is determined so that a dispersion I is introduced into step (B) which has a solid content of from 1 to 80% by weight, preferably from 5 to 40% by weight and particularly preferred 10 to 30% by weight of the dispersion I, wherein in each case the solid content is based on the whole amount of solids present in the dispersion.

Step (B):

Step (B) of the process according to the present invention comprises separating the at least one magnetic agglomerate from the dispersion I of step (A) by subjecting the dispersion I to flotation.

Flotation processes for separating valuable or desired material from undesired material are known per se to the person skilled in the art. The flotation may utilize existing mining industry equipment, including traditional column cells and thickeners. Flotation may be performed at any suitable solids content, pH, and temperature. In one embodiment, during flotation at least one of the following parameters are satisfied: the solids content is from about 10% to about 80%, the pH is from about 5 to about 11, and the temperature is from about 10° C. to about 90° C. For hydrophobic materials, air is usually used to carry the desired material to the surface of the flotation cell. Alternatively, or in combination with the air, synthetic bubbles or beads made from, e.g., polymer or polymer-based material, or silica or silica-based material, or glad or glass-based material. Flotation may also be conducted as inverse flotation. Inverse flotation processes for separating valuable or desired material from undesired material are known per se to the person skilled in the art. Flotation according to the invention is conducted as inverse flotation when the at least one hydrophobic or hydrophobized material in the magnetic agglomerate is the undesired material and the second material is the valuable matter containing material.

In a preferred embodiment, in step (B) of the process according to the invention, the dispersion I of step (A) is introduced to a flotation cell that is aerated to produce air bubbles. The at least one magnetic agglomerate comprising the at least one hydrophobic or hydrophobized material (e.g., the at least one hydrophobic or hydrophobized valuable matter containing material) and the at least one hydrophobic or hydrophobized magnetic particle attaches to the air bubbles, which rise to the surface, forming a froth containing the at least one magnetic agglomerate. The froth is removed from the cell, e.g., by skimming.

In step (B) of the process according to the invention, optionally further assistants can be added. Corresponding assistants are known per se to the person skilled in the art. Reagents which modify surface tension or surface chemistry are generally used for flotation. They are normally classified as frothers, controllers, activators, regulators, such as pH regulators (e.g. $Ca(OH)_2$ or $H_2SO_4$) and depressants (deactivators), and of course collectors which already have been discussed above.

Frothers support the formation of froth which guarantee collectors with an inadequate tendency to froth a sufficiently high froth density and a sufficiently long froth life to enable the laden froth to be completely removed. In general, the use of the collectors mentioned above will eliminate the need to use frothers. In special cases, however, it may necessary or at least advantageous—depending on the flotation process used—to regulate the frothing behaviour. In this case, suitable frothers are, for example, alcohols, more particularly aliphatic C5-C8 alcohols such as, for example, n-pentanol, isoamyl alcohol, hexanol, heptanol, methylbutyl carbinol, capryl alcohol, 4-heptanol, which all have good frothing properties. Natural oils may also be used to support frothing. In particular, alcohols, ethers and ketones, for example alpha-terpineol, borneol, fennel alcohol, piperitone, camphor, fenchol or 1,8-cineol, have both a collecting and a frothing effect. Other suitable frothers are non-ionic compounds, like, for example, polypropylene glycol ethers.

Depressants which may be effectively used for the purpose of the present invention include, for example, naturally occurring polysaccharides, such as guar, starch and cellulose. Quebracho, tannin, dextrin (white dextrin, British gum, and yellow dextrin) and other chemical derivatives may also be used, including in particular the derivatives of starch, guar and cellulose molecules of which the hydroxyl groups may be equipped with a broad range of anionic, cationic and non-ionic functions. Typical anionic derivatives are epoxypropyl trimethylammonium salts while methyl, hydroxyethyl and hydroxypropyl derivatives are mainly used as non-ionic compounds.

Suitable collectors for the flotation of non-sulfidic minerals and ores are in particular polymeric esterquats known as cationic surfactants which have so far been used as softeners for textiles and rinse conditioners for treating hair. The products are disclosed in detail, for example, in EP 0770594 B1 (Henkel); the teaching of this reference is therefore incorporated by reference. More particularly, the polymeric esterquats are obtained by reacting alkanol amines with a mixture of fatty acids and dicarboxylic acids and quaternising the resulting esters in known manner, optionally after alkoxylation.

Suitable polymeric esterquats are derived from amines following general formula (I'A),

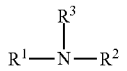

(I'A)

in which $R^1$ represents a hydroxyethyl radical, and $R^2$ and $R^3$ independently from each other stand for hydrogen, methyl or a hydroxyethyl radical. Typical examples are methyldiethanolamin (MDA), monoethanolamine (MES), diethanolamine (DEA) and triethanolamine (TEA). In a preferred embodiment of the present invention, triethanolamine is used as the starting material.

Suitable fatty acids in this context of the invention are understood to be aliphatic carboxylic acids corresponding to formula (I'B), $$R^4COOH \quad \text{(I'B)}$$

in which $R^4CO$ is an aliphatic, linear or branched acyl radical containing 6 to 22 carbon atoms and 0 and/or 1, 2 or 3 double bonds. Typical examples are caproic acid, caprylic acid, 2-ethyl hexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and the technical mixtures thereof obtained, for example, in the pressure hydrolysis of natural fats and oils, in the reduction of aldehydes from Roelen's oxosynthesis or in the dimerization of unsaturated fatty acids. Technical fatty acids containing 12 to 18 carbon atoms, for example, coconut oil, palm oil, palm kernel oil or tallow fatty acids, preferably in hydrogenated or partially hydrogenated form, are preferred.

Dicarboxylic acids suitable for use as starting materials in this context of the invention correspond to formula (I'C), $$HOOC—[X]—COOH \quad \text{(I'C)}$$

in which [X] stands for an optionally hydroxysubstituted saturated or unsaturated alk(en)ylene group containing 1 to 10 carbon atoms. Typical examples are succinic acid, maleic acid, glutaric acid, 1,12-dodecanedioic acid and, in particular, adipic acid.

The fatty acids and the dicarboxylic acids may be used in a molar ratio of 1:10 to 10:1. However, it has proved to be of advantage to adjust a molar ratio of 1:4 to 1:6. The trialkanolamines on the one hand and the acids—i.e. fatty acids and dicarboxylic acids together—on the other hand may be used in a molar ratio of 1:1.3 to 1:2.4. A molar ratio of trialkanolamine to acids of 1:1.4 to 1:1.8 has proved to be optimal. The esterification may be carried out in known manner, for example as described in International patent application WO 91/01295 (Henkel). In one advantageous embodiment, it is carried out at temperatures between 120° C. and 220° C., and more particularly from 130° C. to 170° C. under pressures of 0.01 to 1 bar. Suitable catalysts are hypophosphorous acids and alkali metal salts thereof, preferably sodium hypophosphite, which may be used in quantities of 0.01 to 0.1% by weight, and preferably in quantities of 0.05 to 0.07% b.w. based on the starting materials. In the interests of particularly high colour quality and stability, it has proved to be of advantage to use alkali metal and/or alkaline earth metal borohydrides, for example potassium, magnesium and, in particular, sodium borohydride, as co-catalysts. The co-catalysts are normally used in quantities of 50 to 1000 ppm, and more particularly in quantities of 100 to 500 ppm, again based on the starting materials. Corresponding processes are also the subject of DE 4308792 C1 and DE 4409322 C1 (Henkel) to which reference is hereby specifically made. Mixtures of the fatty acids and dicarboxylic acids may be used or, alternatively, the esterification may be carried out with the two components in successive steps.

Polymeric esterquats containing polyalkylene oxide may be produced by two methods. First, ethoxylated trialkanolamines may be used. This has the advantage that the distribution of alkylene oxide in the resulting esterquat is substantially the same in regard to the three OH groups of the amine. However, it also has the disadvantage that the esterification reaction is more difficult to carry out on steric grounds. Accordingly, the preferred method is to alkoxylate the ester before quaternisation. This may be done in known manner, i.e. in the presence of basic catalysts and at elevated temperatures. Suitable catalysts are, for example, alkali metal and alkaline earth metal hydroxides and alcoholates, preferably sodium hydroxide, and more preferably, sodium methanolate. The catalysts are normally used in quantities of 0.5 to 5% by weight and preferably in quantities of 1 to 3% by weight, based on the starting materials. Where these catalysts are used, free hydroxyl groups are primarily alkoxylated. However, if calcined hydrotalcites or hydrotalcites hydrophobicized with fatty acids are used as catalysts, the alkylene oxides are also inserted into the ester bonds. This method is preferred where the required alkylene oxide distribution approaches that obtained where alkoxylated trialkanolamines are used. Ethylene and propylene oxide and mixtures thereof (random or block distribution) may be used as alkylene oxides. The reaction is normally carried out at temperatures in the range from 100° C. to 180° C. The incorporation of, on average, 1 to 10 moles of alkylene oxide per mole of ester increases the hydrophilicity of the esterquat, improves solubility and reduces reactivity to anionic surfactants.

The quaternisation of the fatty acid/dicarboxylic acid trialkanolamine esters may be carried out in known manner. Although the reaction with the alkylating agents may also be carried out in the absence of solvents, it is advisable to use at least small quantities of water or lower alcohols, preferably isopropyl alcohol, for the production of concentrates which have a solids content of at least 80% by weight, and more particularly, at least 90% by weight. Suitable alkylating agents are alkyl halides such as, for example, methyl chloride, dialkyl sulfates, such as dimethyl sulfate or diethyl sulphate, for example, or dialkyl carbonates, such as dimethyl carbonate or diethyl carbonate for example. The esters and the alkylating agents are normally used in a molar ratio of 1:0.95 to 1:1.05, i.e. in a substantially stoichiometric ratio. The reaction temperature is usually in the range from 40° C. to 80° C., and more particularly, in the range from 50° C. to 60° C. After the reaction it is advisable to destroy unreacted alkylating agent by addition of, for example, ammonia, an (alkanol)amine, an amino acid or an oligopeptide, as described for example in DE 14026184 A1 (Henkel).

In certain cases it may be advantageous to modify, adjust or even support the properties of the collector, e.g., a quaternised alkanolamine-monoester, by adding defined co-collectors such as, for example, cationic surfactants or amphotheric surfactants.

Where cationic surfactants are to be used as co-collectors in accordance with the invention, they may be selected in particular from

- Primary aliphatic amines,
- Alkylenediamines substituted by alpha-branched alkyl radicals,
- Hydroxyalkyl-substituted alkylenediamines,
- Water-soluble acid addition salts of these amines,
- Quaternary ammonium compounds, and in particular
- Quaternised N,N-dialkylaminoalkylamines.

Suitable primary aliphatic amines include, above all, the $C_8$-$C_{22}$ fatty amines derived from the fatty acids of natural fats and oils, for example n-octylamine, n-decylamine, n-dodecylamine, n-tetradecylamine, n-hexadecylamine, n-octadecylamine, n-eicosylamine, n-docosylamine, n-hexadecenylamine and n-octadecenylamine. The amines mentioned may be individually used as co-collectors, although amine mixtures of which the alkyl and/or alkenyl radicals derive from the fatty acid component of fats and oils of animal or vegetable origin are normally used. It is known that amine mixtures such as these may be obtained from the fatty acids obtained by lipolysis from natural fats and oils via the associated nitriles by reduction with sodium and alcohols or by catalytic hydrogenation. Examples include tallow amines or hydrotallow amines of the type obtainable from tallow fatty acids or from hydrogenated tallow fatty acids via the corresponding nitriles and hydrogenation thereof.

The alkyl-substituted alkylenediamines suitable for use as co-collectors correspond to formula (I'D), $$R^6CHR^7—NH—(CH_2)_nNH_2 \quad (I'D)$$

in which $R^6$ and $R^7$ represent linear or branched alkyl or alkenyl radicals and in which n=2 to 4. The production of these compounds and their use in flotation is described in East German Patent DD 64275.

The hydroxyalkyl-substituted alkylenediamines suitable for use as co-collectors correspond to formula (I'E), $$R^8CH(OH)—CHR^9—NH—(CH_2)_nNH_2 \quad (I'E)$$

in which $R^8$ and $R^9$ are hydrogen and/or linear alkyl radicals containing 1 to 18 carbon atoms, the sum of the carbon atoms in $R^8$+$R^9$ being from 9 to 18, and n=2 to 4. The production of compounds corresponding to formula (I'B) and their use in flotation is described in German Patent DE-AS 2547987.

The amine compounds mentioned above may be used as such or in the form of their water-soluble salts. The salts are obtained in given cases by neutralization which may be carried out both with equimolar quantities and also with more than or less than equimolar quantities of acid. Suitable acids are, for example, sulfuric acid, phosphoric acid, acetic acid and formic acid.

The quaternary ammonium compounds suitable for use as co-collectors correspond to formula (I'F), $$[R^{10}R^{11}R^{12}R^{13}N^{+}]X^{-} \quad (I'F)$$

in which $R^{10}$ is preferably a linear alkyl radical containing 1 to 18 carbon atoms, $R^{11}$ is an alkyl radical containing 1 to 18 carbon atoms or a benzyl radical, $R^{12}$ and $R^{13}$ may be the same or different and each represent an alkyl radical containing 1 to 2 carbon atoms, and X is a halide anion, particularly a chloride ion. In preferred quaternary ammonium compounds, $R^{10}$ is an alkyl radical containing 8 to 18 carbon atoms; $R_{11}$, $R_{12}$ and $R_{13}$ are the same and represent either methyl or ethyl groups; and X is a chloride ion.

The most preferred cationic co-collectors, however, encompass the group of quaternised N,N-dialkylaminoalkylamides corresponding preferably to formula (I'G), $$[R^{14}CO-NH-[A]-\underset{R^{17}}{\overset{R^{16}}{N^{+}}}-R^{15}]X^{-} \quad (I'G)$$

in which $R^{14}CO$ stands for is an aliphatic, linear or branched acyl radical containing 6 to 22 carbon atoms, preferably 12 to 18 carbon atoms and 0 and/or 1, 2 or 3 double bonds, [A] is a linear or branched alkylene radical having 1 to 4 carbon atoms, preferably 2 or 3 carbon atoms, $R^{15}$, $R^{16}$ and $R^{17}$ may be the same or different, and each represent an alkyl radical containing 1 to 2 carbon atoms, and X is a halide or a alkyl sulfate, particularly a methosulfate ion. A preferred species is Coco fatty acid-N,N-dimethylaminopropylamide. The products are obtainable also according to known manners, for example by transamidation of N,N-dimethylaminopropane with hydrogenated coco glycerides and subsequent quaternisation by means of dimethyl sulfate. It is also preferred to prepare a mixture of collector and co-collector by blending the intermediate polymeric alkanolamine ester and the intermediate N,N-dialkylalkylamide and subject the mixture to a joint quaternisation.

The ampholytic surfactants which may be used as co-collectors are compounds which contain at least one anionic and one cationic group in the molecule, the anionic groups preferably consisting of sulfonic acid or carboxyl groups, and the cationic groups consisting of amino groups, preferably secondary or tertiary amino groups. Suitable ampholytic surfactants include, in particular, Sarcosides, Taurides, N-substituted aminopropionic acids and N-(1,2-dicarboxyethyl)-N-alkylsulfosuccinamates.

The sarcosides suitable for use as co-collectors correspond to formula (I'H), $$R^{18}CO-\underset{H}{\overset{CH_3}{N^{+}H}}-CH_2COO^{-} \quad (I'H)$$

in which $R^{18}$ is an alkyl radical containing 7 to 21 carbon atoms, preferably 11 to 17 carbon atoms. These sarcosides are known compounds which may be obtained by known methods. Their use in flotation is described by H. Schubert in "Aufbereitung fester mineralischer Rohstoffe (Dressing of Solid Mineral Raw Materials)", 2nd Edition, Leipzig 1977, pages 310-311 and the literature references cited therein.

The taurides suitable for use as co-collectors correspond to formula (I'I), $$R^{19}CO-\underset{H}{\overset{CH_3}{N^{+}H}}-CH_2CH_2SO_3^{-} \quad (I'I)$$

in which $R^{19}$ is an alkyl radical containing 7 to 21 carbon atoms, preferably 11 to 17 carbon atoms. These taurides are known compounds which may be obtained by known methods. The use of taurides in flotation is known; cf. H. Schubert, loc. cit.

N-substituted aminopropionic acids suitable for use as co-collectors correspond to formula (I'J), $$R^{20}(NHCH_2CH_2)_nN^{+H}{}_2CH_2CH_2COO^{-} \quad (I'J)$$

in which n may be 0 or a number from 1 to 4, while $R^{20}$ is an alkyl or acyl radical containing from 8 to 22 carbon atoms. The afore-mentioned N-substituted aminopropionic acids are also known compounds obtainable by known methods. Their use as collectors in flotation is described by H. Schubert, loc. cit. and in Int. J. Min. Proc. 9 (1982), pp 353-384.

The N-(1,2-dicarboxyethyl)-N-alkylsulfosuccinamates suitable for use as co-collectors according to the invention correspond to formula (I'K), $$[^{-}OOCCH_2\overset{COO^{-}}{\overset{|}{CH}}-\underset{R^{21}}{\overset{|}{N^{+}H}}-CO-CH_2\overset{COO^{-}}{\overset{|}{CH}}-SO_3^{-}]\,4M^{+} \quad (I'K)$$

in which $R^{21}$ is an alkyl radical containing 8 to 22 carbon atoms, preferably 12 to 18 carbon atoms, and M is a hydrogen ion, an alkali metal cation or an ammonium ion, preferably a sodium ion. The N-(1,2-dicarboxyethyl)-N-alkylsulfosuccinamates mentioned are known compounds which may be obtained by known methods. The use of these compounds as collectors in flotation is also known; cf. H. Schubert, loc. cit.

Collectors and co-collectors can be used in a weight ratio of about 10:90 to about 90:10, or about 25:75 to about 75:25, or about 40:60 to about 60:40. To obtain economically useful results in the flotation of non-sulfidic minerals or ores, the collectors or, respectively, the mixtures of collectors and co-collectors must be used in a certain minimum quantity. However, a maximum quantity of collectors/co-collectors should not be exceeded, because otherwise frothing is too vigorous and selectivity with respect to the valuable minerals decreases. The quantities in which the collectors are be used in accordance with an embodiment of the invention are governed by the type of minerals or ores to be floated and by their valuable mineral content. Accordingly, the particular quantities required may vary within wide limits. In general, the collectors and collector/co-collector mixtures according to an embodiment of the invention are used in quantities of from 50 to 2000 g/metric ton, and preferably in quantities of from 100 to 1500 g/metric ton of crude ore.

To adjust the rheological behavior of the flotation assistants they may contain solvents in a quantity of 0.1 to 40% b.w., preferably in a quantity of 1 to 30% b.w., and most preferably in a quantity of 2 to 15% b.w. Suitable solvents are, for example, the aliphatic alcohols mentioned above and other alcohols with shorter chain lengths. Thus the flotation aids according to the present invention may contain small quantities of glycols, for example, ethylene glycol, propylene glycol or butylene glycol, and also monohydric linear or branched alcohols, for example, ethanol, n-propanol or isopropanol.

According to the present invention, in step (B) of the process described above, the at least one second material, preferably the gangue of the ore to be treated, is separated from the magnetic material, before magnetic separation is conducted. This has the advantage, that a dispersion can be introduced into the magnetic separation step comprising a lower amount of second material, compared to a process, wherein step (B) is not conducted, which further increases the separation efficiency of the whole process. In addition, smaller or less apparatuses for the magnetic separation step can be used, which is further increasing the scalability, separation- and cost-efficiency of the whole process.

In one embodiment of the present invention, at least 50% by weight of the amount of the at least one second material being present in the dispersion is separated off in step (B).

Further preferred, with conducting step (B) of the process according to the present invention, the suspension volume and solid mass flows that are to be introduced into the magnetic separation step (D) can be reduced to less than 50%, preferably less than 40%, more preferably less than 30%, even more preferred less than 20%, in each case of the original suspension volume and solid mass flows. In addition, the capacity of the process may be increased.

In a usual flotation process using a mixture of water, valuable material, undesired material, chemicals and air, the mineral recovery of the a flotation process can be highly dependent on the mineral particle size distribution entering the flotation cell. Typically, coarse and fine particles recovery can be significantly less than the recovery of the optimal particle size.

The process according to the present invention allows that step (B) can be conducted more efficiently compared to usual flotation processes. Without wishing to be bound to any theory it is believed that the provision of the at least one magnetic agglomerate in step (A) influences the kinetics of the flotation in step (B). By subjecting the dispersion I of step (A) comprising the at least one magnetic agglomerate to flotation the separation of the at least one hydrophobic or hydrophobized material (e.g., the at least one hydrophobic or hydrophobized valuable matter containing material) and the at least one hydrophobic or hydrophobized magnetic particle from the at least one second material is accelerated. Step (B) can thus be conducted at lower energy costs. Further, by subjecting the dispersion I of step (A) comprising the at least one magnetic agglomerate to flotation, particles of valuable matter containing material which are usually not well accessible in flotation processes without the addition of auxiliary agents, e.g. large particles of more than 100 μm and/or small particles of less than 20 μm, can be recovered from the dispersion. The recovery of valuable matter is thus increased without the addition of auxiliary agents.

In a preferred embodiment of the invention the recovery of valuable matter is from about 80% to about 100%, or from about 90% to about 100%, more preferably more than 90%.

In a preferred embodiment of the invention the recovery of valuable matter is from about 2% points to about 30% points, or from about 5% points to about 20% points, more preferably from about 8% points to about 20% points higher compared to usual processes using flotation.

Step (C):

Step (C) of the process according to the present invention comprises disaggregating the at least one magnetic agglomerate of step (B) to obtain a dispersion II containing the at least one hydrophobic or hydrophobized material and the at least one hydrophobic or hydrophobized magnetic particle. In a preferred embodiment of the process of the invention, step (C) comprises disaggregating the at least one magnetic agglomerate of step (B) to obtain a dispersion II containing the at least one hydrophobic or hydrophobized valuable matter containing material and the at least one hydrophobic or hydrophobized magnetic particle, in particular to obtain a dispersion II comprising a lower amount of the at least one second material.

Disaggregation can be carried out by all methods known to those skilled in the art which are suitable for disaggregating the at least one agglomerate in such a way that the at least one magnetic particle can be recovered in reusable form. In a preferred embodiment, the magnetic particle which has been cleaved off is reused in step (A) of the process according to the present invention.

In a preferred embodiment, the disaggregation in step (C) of the process of the invention is affected by treatment of the at least one magnetic agglomerate with a substance selected from the group consisting of organic solvents, basic compounds, acidic compounds, oxidants, reducing agents, surface-active compounds and mixtures thereof.

Examples of basic compounds which can be used according to the invention are aqueous solutions of basic compounds, for example aqueous solutions of alkali metal and/or alkaline earth metal hydroxides, such as KOH or NaOH; lime water, aqueous ammonia solutions, aqueous solutions of organic amines of the general formula $(R^7)_4N^+$, where each $R^7$ is selected independently from $C_1$-$C_8$-alkyl which may optionally be substituted.

Examples of surface-active compounds which can be used according to the invention are nonionic, anionic, cationic and/or zwitterionic surfactants. In a preferred embodiment, the disaggregation is made by the use of biodegradable, preferably nonionic surfactants in concentrations in the range of the critical micelle concentrations.

In a preferred embodiment, the at least one magnetic agglomerate comprising the at least one hydrophobic or hydrophobized material (e.g., the at least one hydrophobic or hydrophobized valuable matter containing material) and the at least one magnetic particle can be disaggregated by means of preferably biodegradable nonionic surfactants added in an amount of from 0.001 to 10% by weight, preferably from 0.01 to 1% by weight, based on the weight of the total liquid phase of suspension. The surfactant concentration is preferably at least more than its critical micelle concentration (CMC).

After disaggregating the at least one magnetic agglomerate according to step (C), the at least one hydrophobic or hydrophobized material and the at least one hydrophobic or hydrophobized magnetic particle are, according to the invention, present as dispersion II in the abovementioned disaggregation reagent, preferably in a mixture of water and surfactant.

Step (D):

Step (D) of the process according to the present invention comprises separating the at least one hydrophobic or hydrophobized magnetic particle from the dispersion II containing the at least one hydrophobic or hydrophobized material by applying a magnetic field. In a preferred embodiment, step (D) of the process according to the present invention comprises separating the at least one hydrophobic or hydrophobized magnetic particle from the dispersion II containing the at least one hydrophobic or hydrophobized valuable matter containing material by applying a magnetic field. The magnetic separation may be conducted by any method known to the skilled artisan. In general, methods for separating magnetic parts as a magnetic fraction from a mixture comprising them and non-magnetic parts as the remaining non-magnetic fraction are known to the skilled artisan.

In a preferred embodiment, step (D) may be carried out with any magnetic equipment that is suitable to separate magnetic particles from dispersion, e. g. drum separators, high or low intensity magnetic separators, continuous belt type separators or others.

In another preferred embodiment, step (D) may be carried out by introducing a permanent magnet into the reactor in which the dispersion II of step (C) is present. In a preferred embodiment, a dividing wall composed of non-magnetic material, for example the wall of the reactor, may be present between the permanent magnet and the mixture to be treated. In a further preferred embodiment of the process of the invention, an electromagnet is used in step (D) which is only magnetic when an electric current flows. Suitable apparatuses are known to those skilled in the art.

For example, suitable apparatus and methods of magnetic separation may be found in "Magnetic techniques for the treatment of materials", Jan Svoboda, Kluwer Academic Publishers, 2004.

In a preferred embodiment, the magnetic separation equipment allows washing the magnetic concentrate during separation with a dispersant, preferably water. The washing preferably allows removing inert material from the magnetic concentrate.

In a preferred embodiment, step (D) is conducted continuously or semi-continuously, wherein preferably the dispersion to be treated flows through a separator. Flow velocities of the dispersion to be treated are in general adjusted to obtain an advantageous yield of separated magnetic particles. In a preferred embodiment, flow velocities of the dispersion to be treated are 10 mm/s to 1000 mm/s.

The pH-value of the dispersion which is treated in step (D) may in general be from about 5 to about 13 and preferably from about 7 to about 12. In a preferred embodiment, no adjustment of the pH of the dispersion obtained in step (C) is necessary.

Step (D) of the process of the invention may be carried out at any suitable temperature. In a preferred embodiment, step (D) is carried out at a temperature from about 10 to about 60° C. and preferably at ambient temperature.

In a preferred embodiment, step (D) is performed in a continuous or semi-continuous process wherein the dispersion is preferably mixed by turbulent flow, and is more preferably not additionally stirred.

In a preferred embodiment, the apparatus used for the magnetic separation according to step (D) of the present invention is an apparatus as disclosed in WO 2012/104292.

In another preferred embodiment, the apparatus used for the magnetic separation according to step (D) of the present invention is an apparatus as disclosed in WO 2011/131411, WO 2011/134710, WO 2011/154178, DE 10 2010 023 130, DE 20 2011 104 707, WO 2011/107353, DE 10 2010 061 952, WO 2012/116909, WO 2012/107274 or WO 2013/167634.

As one preferred apparatus for the magnetic separation, the apparatus comprises at least one loop-like canal through which the dispersion flows.

In a preferred embodiment, the apparatus used in step (D) of the process according to the present invention for the magnetic separation comprises at least one loop-like canal through which the dispersion flows and which has at least two inlet and at least two outlets.

In one embodiment, the apparatus that is preferably used in step (D) of the process according to the present invention further comprises at least one magnet that is movable alongside the canal.

In one embodiment, the apparatus for the magnetic separation of the invention is operated in countercurrent.

The magnets used according to the invention can be any magnets known to those skilled in the art, for example permanent magnets, electromagnets and combinations thereof. In a preferred embodiment, a multiplicity of magnets is arranged around the loop-like canal. In a preferred embodiment, the magnetic constituents present in the dispersion accumulate at least in part, preferably in their entirety, i.e. in a proportion of at least 60% by weight, preferably at least 90% by weight, particularly preferably at least 99% by weight, on the side of the loop-like canal facing the at least one magnet as a result of the magnetic field, wherein the % by weight is based on the total weight of magnetic constituents.

According to a preferred embodiment, the at least one hydrophobic or hydrophobized magnetic particle separated in step (D) is recycled into step (A) again.

According to a further preferred embodiment of the process according to the present invention, step (D) of the process according to the present invention is conducted more than once, for example twice, three times, four times etc.

In a preferred embodiment, the dispersion II that is separated in step (D) of the process according to the present invention contains hydrophobic or hydrophobized valuable matter containing material and provides a grade of the at least one valuable matter containing material of 0.000001 to 80% by weight valuable matter by weight, wherein the weight is based on the valuable matter present in the hydrophobic or hydrophobized valuable matter containing material and the at least one second material as mentioned above. The grade may then for example be determined by X-ray fluorescence, fire assay and/or inductively coupled plasma mass-spectroscopy (ICP_MS).

In a preferred embodiment physical or chemical data are measured in at least one of the steps (A) to (D) in order to provide feedback to a process control circuit. For example, the international publication WO 2011/120826 discloses ways how these data are recorded.

Definitions

As used herein, the term "valuable matter" refers to any material that may be of commercial value. Examples of valuable matter include, but are not limited to, elemental metals such as Ag, Au, Pt, Pd, Rh, Ru, Ir, Os, Cu, Mo, Ni, Mn, Zn, Pb, Te, Sn, Hg, Re, V, Fe or mixtures thereof. In a preferred embodiment, the valuable matter includes PGMs, Au, Ag, Cu, rare earths and the like. A "valuable matter containing material" refers a material that contains such a valuable matter in any form, such as in ore minerals, metals in pure form, alloys or mixtures thereof. For example, a valuable matter containing material may be an ore mineral comprising the valuable matter Pt.

As used herein, the term "dispersion" refers to material comprising more than one phase wherein at least one of the phases consists of finely divided phase domains, often in the colloidal size range, dispersed throughout a continuous phase.

As used herein, the term "magnetic agglomerate" refers to a material resulting from the agglomeration between at least one hydrophobic or hydrophobized magnetic particle and at least one further hydrophobic or hydrophobized material generally as a result of all attractive forces known to those skilled in the art, for example as a result of hydrophobic interactions and/or magnetic forces. In the process according to the present invention, the magnetic agglomerate comprises, preferably, essentially only the at least one hydrophobic or hydrophobized material (e.g., the at least one valuable matter containing material) and the at least one hydrophobic or hydrophobized magnetic particle while the at least one second material and the at least one hydrophobic or hydrophobized magnetic particle do not or essentially do not agglomerate together.

As used herein, the term "disaggregating" refers to a process of separating agglomerated materials. Disaggregation can be carried out by all methods known to those skilled in the art which are suitable for separating agglomerated materials. In the process according to the present invention, disaggregating is affected by treatment of the at least one magnetic agglomerate, preferably without changing chemically the agglomerated materials, in particular the at least one valuable matter containing material and the magnetic particle, preferably with a substance selected from the group consisting of organic solvents, basic compounds, acidic compounds, oxidants, reducing agents, surface-active compounds and mixtures thereof.

For the purposes of the present invention, "hydrophobized" as in "hydrophobized particle" means that a particle is treated with a surface-modifying substance (e.g. a hydrophobizing agent or a collector) and provides a contact angle between water and the surface of a particle against air of ≥90°.

For the purposes of the present invention, "hydrophobic" as in "hydrophobic particle" means that the corresponding particle can be hydrophobic by itself or can subsequently be hydrophobized by treatment with at least one surface-modifying substance. It is also possible for a particle which is hydrophobic per se to be additionally hydrophobized by treatment with at least one surface-modifying substance. Examples of surface-modifying substances include, but are not limited to, a hydrophobizing agent and a collector. Within the scope of the present invention, the term "hydrophobic" also includes that a "hydrophobized substance" such as a "hydrophobized magnetic particle" or a valuable matter containing material treated with a collector has a contact angle between water and the optionally hydrophobized surface of a particle against air of ≥90°.

In the scope of the present invention, "hydrophilic" means that a corresponding solid "hydrophilic particle" has a contact angle of water against air of <90°.

Methods to determine the contact angle are well known to the skilled artisan. For example, for the determination of the contact angel against water may be determined by optical drop shape analysis, e.g. using a DSA 100 contact angle measuring device of Krüsse (Hamburg, Germany) with the respective software. Typically 5 to 10 independent measurements are performed in order to determine a reliable average contact angle.

As used herein, the term "derivative" such as in "a compound of formula (I) or derivatives thereof" preferably refers to salts, the protonated form or the deprotonated form of said compounds. Preferred salts as derivatives of a compound wherein the compound represents the anionic part of the salt include salts wherein the respective one or more cation of the salt is sodium, potassium, calcium, magnesium or $N(R^1)_4^+$, wherein $R^1$ is an unsubstituted or substituted $C_1$-$C_{12}$-alkyl Preferred salts as derivatives of a compound wherein the compound is the cation include salts wherein the respective one or more anion of the salt is Cl, Br, I, F, carbonate, phosphate, sulphate, sulphide or hydroxide and the like. The person skilled in the art is aware that the protonated and/or deprotonated form of a compound may depend on the pH in a dispersion.

As used herein, the term "optionally substituted" refers to a group that is either unsubstituted or substituted, e.g. with 1, 2, 3, 4 or 5 substituents. Preferred substituents are F, Cl, Br, I, OH, SH, —COOH, —$NH_2$, —CN, —C(O)N $H_2$ (amido), —C(O)NHC(O)—$C_1$-$C_{30}$-alkyl (imido), —O—$C_1$-$C_{30}$-alkyl (ether), —C(O)—$C_1$-$C_{30}$-alkyl (aldehyde), (=O), —S—$C_1$-$C_{30}$-alkylthioether, —C(O)NHOH (hydroxamate) or —N($R_1$)—C(O)OH (carbamate).

As used herein, the term "$C_1$-$C_{30}$-alkyl" refers to linear or branched hydrocarbons having 1 to 30 carbon atoms. Non-limiting example of $C_1$-$C_{30}$ alkyl include, but are not limited to methyl, ethyl, propyl, isopropyl, n-butyl, isobutyl, tert-butyl, pentyl, in particular n-pentyl, isopentyl, tert-pentyl, n-hexyl, isohexyl, tert-hexyl, n-heptyl, isoheptyl, tert-heptyl, n-octyl, isooctyl, tert-octyl, nonyl, n-nonyl, isononyl, tert-nonyl, n-decyl, isodecyl, tert-decyl, undecyl, n-undecyl, isoundecyl, tert-undecyl, or dodecyl, n-dodecyl, isododecyl or tert-dodecyl.

As used herein, the term "$C_2$-$C_{30}$-alkenyl" refers to linear or branched hydrocarbons having 2 to 30 carbon atoms and at least one C—C double bond. Examples of alkenyl which are particularly preferred according to the invention are ethenyl (vinyl), propenyl, in particular n-propenyl, isopropenyl, butenyl, n-butenyl, isobutenyl, tert-butenyl, pentenyl, in particular n-pentenyl, isopentenyl, tert-pentenyl, hexenyl, in particular n-hexenyl, isohexenyl, tert-hexenyl, heptenyl, in particular n-heptenyl, isoheptenyl, tert-heptenyl, octenyl, in particular n-octenyl, isooctenyl, tert-octenyl, nonenyl, in particular n-nonenyl, isononenyl, tert-nonenyl, decenyl, in particular n-decenyl, isodecenyl, tert-decenyl, undecenyl, in particular n-undecenyl, isoundecenyl, tert-undecenyl, or dodecenyl, in particular n-dodecenyl, isododecenyl or tert-dodecenyl.

As used herein, the term "$C_1$-$C_{30}$-heteroalkyl" refers to linear or branched hydrocarbons having 1 to 30 carbon atoms and at least one heteroatom selected form the group consisting of N, O, P and S. The at least one heteroatom may be either the point of attachment, such as in -Het-$CH_2$—, part of the chain, such as in —$CH_2$-Het-$CH_2$—, or the heteroatom may be terminal, such as in —$CH_2$-Het, wherein "Het" denotes the heteroatom. In case the heteroatom is terminal, the free valences may be occupied by hydrogen or a $C_1$-$C_{30}$-alkyl group.

As used herein, the term "$C_6$-$C_{30}$-aryl" refers to aromatic carbocyclic rings of 6 to 30 ring members, including both mono, bi-, and tri-cyclic ring systems. Non-limiting examples of $C_6$-$C_{30}$-aryl include -indenyl, -phenyl, -naphthyl-, acenaphthyl-antranyl, -phenanthryl and the like.

As used herein, the term "$C_6$-$C_{30}$-cycloalkyl" refers to mono-, bi- or tricyclic saturated hydrocarbons having from 6 to 30 carbon atoms. Representative $C_6$-$C_{30}$-cycloalkyl include cyclohexyl, cecloheptyl, cyclooctyl, cyclononyl, cyclodecyl, cycloundecyl and cyclododecyl.

As used herein, the term "$C_6$-$C_{30}$ heterocycloalkyl" refers to a 6 to 30-membered mono-, bi- or tricyclic heterocyclic ring which is either saturated, unsaturated, non-aromatic or aromatic. The heteroatom in the heterocycloalkyl may be selected from O, S, P and N, wherein the nitrogen may be quartarnized and the S may also be present in form of S(O) or $S(O)_2$.

As used herein, the term "$C_6$-$C_{30}$-aralkyl" refers to aromatic mono-, bi or tricyclic rings that are substituted with 1, 2, 3, 4 or 5 alkyl groups. Examples of $C_6$-$C_{30}$-arylalkyl include tolyl, xylyl, propylbenzyl and hexylbenzyl.

As used herein, the term "collector" refers to a compound that selectively forms a hydrophobic layer on a given material, e.g. a valuable matter containing material such as a mineral surface. Collectors are typically known for their use in flotation processes. A collector may be an ionizing collector, such as a cationic collector or an anionic collector; or a non-ionizing collector. The term "ionizing" as used in "ionizing collector" refers to a collector that dissociates in water in at least two groups, such as in a cation and an anion. The term "anionic collectors" refers to collectors wherein the anionic part forms the hydrophobic layer on a given mineral. The term "cationic collector" refers to a collector wherein the cationic part forms a hydrophobic layer on a given mineral surface. The term "non-ionizing collector" refers to collectors which are usually liquid, non-polar hydrocarbons that do not dissociate in water.

Examples of anionic collectors include, but are not limited to, oxyhydryl collectors such as carboxylates, alkyl sulfates, sulfonates, hydroxamates, sulfosuccinates and sulfosuccinamates, phosphonic acid derivatives, phosphoric acid ester, sulfhydryls, sulfur and nitrogen derivatives of carbonic acids, preferably xanthates, dithiophosphinates, trithiocarbonates and substituted mercaptobenzothiozoles and dithiophosphates.

Examples of cationic collectors include, but are not limited to, compounds comprising at least one primary, secondary, tertiary or quaternary amine such as fatty amines or ether amines.

Examples of non-ionizing collectors include, but are not limited to, kerosene, transformer oils and synthetic hydrocarbon oils.

Further, collectors may also have a polymeric structure such as the polymers described in WO 2013/038192 A1.

Non-limiting examples of collectors are also found in the collector handbook of floating agents: chemistry, theory and practice, Srdjan M. Balutovic, February 2008, Elsevier.

As used herein, the term "grade" refers to a valuable matter content present in a valuable matter containing material. A hydrophobic or hydrophobized valuable matter containing material present in the magnetic agglomerates with at least one hydrophobic or hydrophobized magnetic particle may also have a grade of valuable matter which may be determined after deagglomeration and magnetic separation from the respective magnetic particles. As used herein, the grade is % by weight or ppm by weight of a valuable matter of an isolated dry solid. Methods to determine the grade of a valuable matter containing material are commonly known to the skilled person. For example, the grade may be determined by X-ray fluorescence, fire assay and/or inductive coupled plasma mass spectrometry.

As used herein, the term "rare earth metal" refers to one of a set of seventeen chemical elements in the periodic table, namely the fifteen lanthanides plus scandium and yttrium.

As used herein, the term "ore" refers to a type of rock that contains valuable matter such as valuable metal that can be extracted from the rock. The ores may be extracted through mining.

The ore may contain a desired material, such as an ore mineral, and also an undesired second material such as gangue.

As used herein, the term "mineral" or "ore mineral" refers to a naturally occurring substance that is solid inorganic and representable by a chemical formula, which is usually abiogenic and may have an ordered atomic structure. An ore mineral may carry a valuable matter. The ore mineral is different from a rock, which can be an aggregate of minerals and/or non-minerals. Examples of minerals include, but are not limited to, sulfides, oxides, halides, carbonates, sulfates, and phosphates of valuable metals.

As used herein, the term "slag" or "artificially prepared slag" or "metallurgical slag" refers to the by-product of a smelting process.

The main use of a smelting process is to convert an ore, scrap or a material mixture containing different metals into a form from which the desired metals can be skimmed as a metal layer and the undesired metal oxides, e.g. silicates, alumina, etc., remain as the slag. During smelting, a silicate-rich liquid phase may separate from the heavier metal melt. The latter is flowing through dedicated openings in the melting vessel and is further processed. The phase separation is however not complete, but a fraction of the desired metal becomes trapped in the liquid slag phase and remains dispersed there after solidification resulting in a so-called "mixing layer".

In general, one can distinguish between oxidative and reductive smelter operation. The slag material that can be separated according to the present invention can either be obtained under reductive conditions or can be obtained under oxidative conditions. For example, slag produced in PGM recovery operations, for example in Pt mines or old catalyst reprocessing etc., is usually formed under reducing conditions, which are exemplarily explained in the following. The energy needed to heat the mass to beyond the melting point is in general provided by an external heating, e.g. gas burners, or an electric arc. Often, carbon or other reducing materials are added. The goal is to reduce noble metal compounds to metal state. Reduced metals and the oxidic phase are immiscible and demix. Slags produced under reductive conditions often contain residual PGMs as free metals or alloys with other transition metals, particularly iron. These alloys are often ferromagnetic and can be separated from the slag matrix by a magnetic field after liberation. The losses of PGM into slag are almost exclusively due to incomplete demixing of the liquid metal and liquid slag phases—no significant formation of PGM solid solution in the slag occurs.

In a smelter that is operated under reductive conditions, the most base metal sulphides remain as sulphides. Some metal species, e.g. PGMs, may also remain as the native metal or tend to migrate into the magnetic fraction. Magnetite is often fed into the smelter to support the formation of the slag. Platinum and also rhodium preferably feature this behaviour to migrate to the magnetic fraction thus after the smelting process these precious group metals are hidden in the magnetic fraction, which is preferably in the slag, as dopants.

Is a smelter operated under oxidative conditions, the base metals sulphides and also some native metals compounds are oxidized. In this case, the magnetic separation process according to the present invention is rarely used without pre-treatment. However, if a surface treatment, for example a selective sulphidization of the desired metal of value, is preferably executed, the magnetic separation process according to the present invention can be employed as described herein. Besides the preferred sulphidization, also other surface treatments can be used to convert the desired metal species into a sulphidic, native or magnetic form. These treatments are known to the skilled artisan.

As used herein, the term "ore-bearing slag" refers to slag that comprises ores, i.e. slag that inter alia comprises a valuable matter containing material such as an ore mineral. The ore-bearing slag may also comprise at least one second material such as gangue.

As used herein, the term "wet ore tailing" refers to a dispersion comprising ore as a "tailing", i.e. as the undesired fractions left over after the process of separating the valuable fraction from the uneconomic fraction of an ore. However, such tailings may still comprise at least one valuable matter containing material but also at least one undesired second material.

As used herein, the term "canal" describes the body structure of an apparatus. According to the present invention the wording "canal" describes an apparatus, which is, in its easiest embodiment, formed by a tube, e.g. the canal according to the invention has a length that is larger than the breadth or diameter of the canal. The cross-section of the canal can have any suitable shape, for example oval, annular, circular, square, rectangular, irregular or a combination of these shapes, preferably square or rectangular.

As used herein, the term "loop-like" describes a canal, which, in a simple embodiment, is formed like a loop. In a preferred embodiment the loop-like canal forms a part of a circular arc, for example at least 90°, preferably at least 120°, more preferably at least 180°, in particular at least 270°, of a circular arc.

As used herein, the term "semimetal" refers to semimetals or "metalloids" in general which are known to the skilled artisan. The term "semimetal" includes boron, silicon, germanium, arsenic, antimony, tellurium, carbon, aluminium, selenium, polonium and astatine. Preferably, the semimetal is selected from the group consisting of boron, silicon, germanium, arsenic, antimony and tellurium.

As used herein, the term "complex oxide matrices" refers to a mixed metal oxide such as binary or higher-level oxides of the respective metals. Examples of complex oxide matrices include, but are not limited to, Ti—Si oxides, Si—Cr oxides, Si—Zr oxides and the like.

As used herein, the term "selectively" means that the partition coefficient of the surface-modifying substance between the surface of a first material and the surface of an at least one second material is generally >1, preferably >100, particularly preferably >10 000. For example, if the surface-modifying substance is a collector, it preferentially binds to the surface of the at least one valuable matter containing material (first material) compared to the surface of the at least one second material. In an alternative example, the hydrophobizing agent preferentially binds to the surface of the magnetic particle (first material) compared to the surface of the at least one second material.

The present invention also relates to the following items:

(1) A process for the separation of at least one hydrophobic or hydrophobized material from a dispersion comprising said at least one hydrophobic or hydrophobized material and at least one second material, wherein the process comprises the following steps:
   (A) contacting the dispersion comprising the at least one hydrophobic or hydrophobized material and the at least one second material with at least one hydrophobic or hydrophobized magnetic particle to provide a dispersion I comprising at least one magnetic agglomerate comprising the at least one hydrophobic or hydrophobized material and the at least one hydrophobic or hydrophobized magnetic particle;
   (B) separating the at least one magnetic agglomerate from the dispersion I of step (A) by subjecting the dispersion I to flotation;
   (C) disaggregating the at least one magnetic agglomerate of step (B) to obtain a dispersion II containing the at least one hydrophobic or hydrophobized material and the at least one hydrophobic or hydrophobized magnetic particle; and
   (D) separating the at least one hydrophobic or hydrophobized magnetic particle from dispersion II containing the at least one hydrophobic or hydrophobized material by applying a magnetic field.

(2) The process according to item (1), wherein the at least one hydrophobic or hydrophobized material has been pre-treated with at least one collector or wherein at least one collector is added in step (A) or (B).

(3) The process of item (2), wherein the at least one collector is an ionizing collector or a non-ionizing collector.

(4) The process of item (3), wherein the at least one collector is a compound of formula (I) or derivative thereof $$[(A)_m(Z)_n]_o \quad (I)$$

and wherein each A is independently selected from $C_1$-$C_{30}$-alkyl, $C_2$-$C_{30}$-alkenyl $C_1$-$C_{30}$-heteroalkyl, $C_6$-$C_{30}$-aryl, $C_6$-$C_{30}$-cycloalkyl, $C_6$-$C_{30}$-heteroalkyl, $C_6$-$C_{30}$-heterocycloalkyl, $C_6$-$C_{30}$-aralkyl, each of which may be unsubstituted or optionally substituted;

each Z is independently selected from anionic groups, cationic groups or non-ionic groups;

m is an integer of 1, 2, 3, 4, 5, 6, 7, 8, 9 or 10;

n is an integer of 1, 2, 3, 4, 5, 6, 7, 8, 9 or 10; and o is an integer of 1, 2, 3, 4, 5, 6, 7, 8, 9 or 10 to 100.

(5) The process according to item (4), wherein Z is selected from:

a)

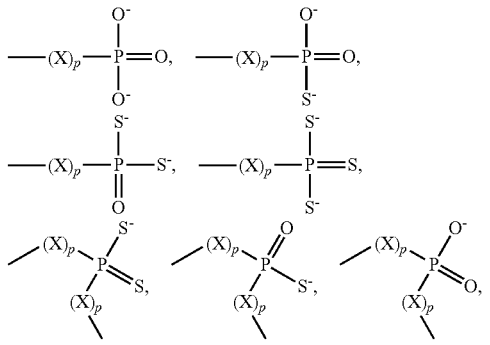

-continued

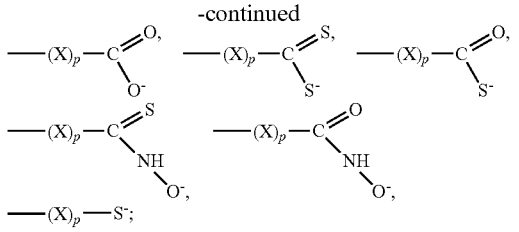

b)

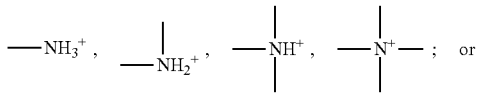

c)

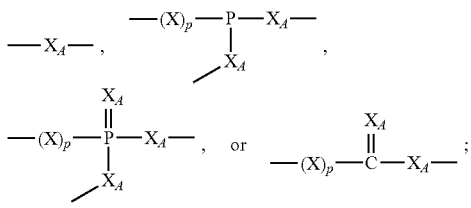

wherein each X is independently selected from the group consisting of O, S, NH, $CH_2$ and each p is independently selected from the integer 0, 1 or 2 and each $X_A$ is independently selected from O or S.

(6) The process according to any one of items (2) to (5), wherein the at least one collector is selected from:

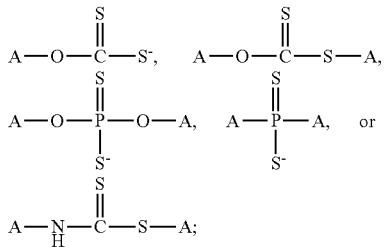

or a derivative thereof.

(7) The process according to any one of items (1) to (9), wherein the dispersion comprising the at least one hydrophobic or hydrophobized material and the at least one second material in step (A) comprises ore-bearing slag and/or wet ore tailing comprising at least one valuable matter containing material.

(8) The process according to item (7), wherein the valuable matter is selected from the group consisting of Ag, Au, Pt, Pd, Rh, Ru, Ir, Os, Cu, Mo, Ni, Mn, Zn, Pb, Te, Sn, Hg, Re, V, Fe; or combinations or alloys thereof.

(9) The process according to items (7) or (8), wherein the valuable matter is Ru, Rh, Pd, Os, Ir, Pt or combinations or alloys thereof.

(10) The process according to any one of items (7) to (9), wherein the at least one valuable matter comprising material is present in form of an ore mineral.

(11) The process according to any one of items (1) to (10), wherein dispersion I obtained in step (A) comprises from about 5 to about 60% by weight solid content wherein the solid content is based on the total amount of solids present.

(12) The process according to any one of items (1) to (11), wherein the at least one hydrophobic or hydrophobized magnetic particle is selected from the group consisting of magnetic metals and mixtures thereof, ferromagnetic alloys of magnetic metals and mixtures thereof, magnetic iron oxides, or cubic ferrites of general formula (II)

$$M^{2+}_{x}Fe^{2+}_{1-x}Fe^{3+}_{2}O_4 \quad \text{(II)}$$

wherein

M is selected from Co, Ni, Mn, Zn and mixtures thereof and x is ≤1, hexagonal ferrites and mixtures thereof.

(13) The process according to any one of items (1) to (12), wherein the at least one hydrophobic or hydrophobized magnetic particle is a hydrophobized magnetic particle.

(14) The process according to item (13), wherein the at least one hydrophobized magnetic particle is a magnetic particle treated with a hydrophobizing agent.

(15) The process according to item (14), wherein the hydrophobizing agent is a compound of formula (IV) or derivative thereof $$R^5_v—Si(OR^6)_{4-v} \quad \text{(IV)}$$

wherein each $R^5$ is independently selected from hydrogen; linear or branched, optionally substituted $C_1$-$C_{30}$-alkyl; linear or branched, optionally substituted $C_2$-$C_{30}$-alkenyl; linear or branched, optionally substituted $C_2$-$C_{30}$-alkynyl; optionally substituted $C_3$-$C_{20}$-cycloalkyl; optionally substituted $C_3$-$C_{20}$-cycloalkenyl; optionally substituted $C_1$-$C_{20}$-heteroalkyl; optionally substituted $C_5$-$C_{22}$-aryl; optionally substituted $C_6$-$C_{23}$-alkylaryl; optionally substituted $C_6$-$C_{23}$-arylalkyl; optionally substituted $C_5$-$C_{22}$-heteroaryl;

each $R^6$ is independently selected from hydrogen; linear or branched, optionally substituted $C_1$-$C_{30}$-alkyl; linear or branched, optionally substituted $C_2$-$C_{30}$-alkenyl; linear or branched, optionally substituted $C_2$-$C_{30}$-alkynyl; optionally substituted $C_3$-$C_{20}$-cycloalkyl; optionally substituted $C_3$-$C_{20}$-cycloalkenyl; optionally substituted $C_1$-$C_{20}$-heteroalkyl; optionally substituted $C_5$-$C_{22}$-aryl; optionally substituted $C_6$-$C_{23}$-alkylaryl; optionally substituted $C_6$-$C_{23}$-arylalkyl; optionally substituted $C_5$-$C_{22}$-heteroaryl;

and v is the integer 1, 2 or 3.

(16) The process according to item (15), wherein the compound of formula (IV) or derivative thereof is a compound selected from the group consisting of $(NaO)(CH_3)Si(OH)_2$, $(NaO)(C_2H_5)Si(OH)_2$, $(NaO)(C_5H_{11})Si(OH)_2$, $(NaO)(C_8H_{17})Si(OH)_2$, $(KO)(CH_3)Si(OH)_2$, $(KO)(C_2H_5)Si(OH)_2$, $(KO)(C_5H_{11})Si(OH)_2$, $(KO)(C_8H_{17})Si(OH)_2$, $(NH_4O)(CH_3)Si(OH)_2$, $(NH_4O)(C_2H_5)Si(OH)_2$, $(NH_4O)(C_5H_{11})Si(OH)_2$, $(NH_4O)(C_8H_{17})Si(OH)_2$, $(NaO)_2(CH_3)Si(OH)$, $(NaO)_2(C_2H_5)Si(OH)$, $(NaO)_2(C_5H_{11})Si(OH)$, $(NaO)_2(C_8H_{17})Si(OH)$, $(KO)_2(CH_3)Si(OH)$, $(KO)_2(C_2H_5)Si(OH)$, $(KO)_2(C_5H_{11})Si(OH)$, $(KO)_2(C_8H_{17})Si(OH)$, $(NH_4O)_2(CH_3)Si(OH)$, $(NH_4O)_2(C_2H_5)Si(OH)$, $(NH_4O)_2(C_5H_{11})Si(OH)$, $(NH_4O)_2(C_8H_{17})Si(OH)$, $(NaO)_3(CH_3)Si$, $(NaO)_3(C_2H_5)Si$, $(NaO)_3(C_5H_{11})Si$, $(NaO)_3(C_8H_{17})Si$, $(KO)_3(CH_3)Si$, $(KO)_3(C_2H_5)Si$, $(KO)_3(O_5H_{11})Si$, $(KO)_3(C_8H_{17})Si$, $(NH_4O)_3(CH_3)Si$, $(NH_4O)_3(C_2H_5)Si$, $(NH_4O)_3(C_5H_{11})Si$, $(NH_4O)_3(C_8H_{17})Si$, $(NaO)(CH_3)_2Si(OH)$, $(NaO)(C_2H_5)_2Si(OH)$, $(KO)(CH_3)_2Si(OH)$, $(KO)(C_2H_5)_2Si(OH)$, $(NaO)_2(CH_3)_2Si$, $(NaO)_2(C_2H_5)_2Si$, $(KO)_2(CH_3)_2Si$, $(KO)_2(C_2H_5)_2Si$, $Ca^{2+}[(O^-)(CH_3)Si(OH)_2]_2$, $Ca^{2+}[(O^-)(C_2H_5)Si(OH)_2]_2$, $Ca^{2+}[(O^-)(C_5H_{11})Si(OH)_2]_2$, $Ca^{2+}[(O^-)(C_8H_{17})Si(OH)_2]_2$, $Ca^{2+}[(O^-)(CH_3)_2Si(OH)]_2$, $Ca^{2+}[(O^-)(C_2H_5)_2Si(OH)]_2$, $Ca^{2+}[(O^-)_2(CH_3)Si(OH)]$, $Ca^{2+}[(O^-)_2(C_2H_5)Si(OH)]$, $Ca^{2+}[(O^-)_2(C_5H_{11})Si(OH)]$, $Ca^{2+}[(O^-)_2(C_8H_{17})Si(OH)]$, $Ca^{2+}[(O^-)_2(CH_3)_2Si]$, $Ca^{2+}[(O^-)_2(C_2H_5)_2Si]$ or combinations thereof.

(17) The process according to any one of items (1) to (16), wherein at least 50% by weight of the whole amount of the at least one second material being present in the dispersion that is originally introduced into the process is separated off in step (B).

(18) The process according to any one of items (1) to (17), wherein the at least one hydrophobic or hydrophobized magnetic particle separated in step (D) is recycled into step (A) again.

(19) The process according to any one of items (1) to (18), wherein the dispersion medium in dispersion I and dispersion II is water.

(20) The process according to any one of items (1) to (19), wherein the at least one hydrophobic or hydrophobized material and the at least one second material are comminuted to particles having a particles size of from about 100 nm to about 400 μm in or before step (A) or (B).

(21) The process according to any one of items (1) to (20), wherein step (D) is repeated 1 to 4 times.

(22) The process according to any one of items (1) to (21), wherein the at least one hydrophobic or hydrophobized material is a hydrophobic or hydrophobized valuable matter containing material.

(23) The process according to item (22) further comprising step (E) that is conducted after step (D):

(E) isolating the valuable matter containing material from the dispersion II.

(24) The process according to item (23), further comprising step (F) that is conducted after step (E):

(F) processing of the isolated valuable matter containing material obtained in step (G) by smelting, extracting and/or wet chemical refining.

(25) The process according to any one of items (1) to (24), wherein the recovery of valuable matter is from about 80% to about 100%.

(26) The process according to any one of items (1) to (24), wherein the recovery of valuable matter is from about 90% to about 100%.

(27) The process according to item (26), wherein the recovery of valuable matter is more than 90%.

(28) The process according to any one of items (1) to (27), wherein the recovery of valuable matter is from about 2% points to about 30% points higher compared to usual processes using flotation.

(29) The process according to any one of items (1) to (27), wherein the recovery of valuable matter is from about 5% points to about 20% points higher compared to usual processes using flotation.

(30) The process according to item (29), wherein the recovery of valuable matter is from about 8% points to about 20% points higher compared to usual processes using flotation.

EXAMPLES

Examples are conducted with porphyry copper ore from Chile (PSD (Malvern Mastersizer 2000) D80=49.6 μm)

1 a) Kinetic Carrier Flotation—Inventive i) Conditioning

A 2.6 I Denver-Cell vessel with external aeration unit (100 μm metal frit) is used for the experiments. The pH of the slurry is set to pH 10 using lime. Rotor speed of Denver Cell is 900 rpm, collector dosage is 22 g/t potassium amyl xanthate (PAX) and 6 g/t of Diesel (Shellsol D40) related to the dry ore material used. Conditioning time of ore and collector is 3 mins.

Slurry solid content during conditioning and flotation is maintained at 36.5%

Magnetite (dosage as specified in trial, e.g. 1% of solids) is pre-dispersed for 15 minutes using iso-propanol as wetting agent. Ratio of magnetite/iso-propanol is 0.5.

ii) Flotation

After the conditioning time the magnetite is added to the Denver-Cell vessel. Before the cell is aerated, the slurry and added magnetite are stirred for 15 mins to ensure agglomerate formation.

After 15 mins 14.7 g Methyl isobutyl carbinol (MIBC) per ton of processed solids are used as frother. Aeration rate of the cell is set to 350 I/h.

Froth samples are collected after 20 sec; 40 sec; 1 min.; 2 min.; 3 min.; 4 min.; 7 min.; 11 min.

iii) Evaluation

The sample slurries are filtered, dried and weighed. Representative aliquots are milled and chemically analyzed using a XRF-device calibrated specifically for the used ore feed.

1b) Kinetic Flotation—Comparative i) Conditioning

A 2.6 I Denver-Cell vessel with external aeration unit (100 μm metal frit) is used for the experiments. The pH of the slurry is set to pH 10 using lime. Rotor speed of Denver Cell is 900 rpm, collector dosage is 22 g/t potassium amyl xanthate (PAX) and 6 g/t of Diesel (Shellsol D40) related to the dry ore material used. Conditioning time of ore and collector is 3 mins.

Slurry solid content during conditioning and flotation is maintained at 36.5% ii) Flotation

Before the cell is aerated, the slurry and added magnetite are stirred for 15 mins to accommodate the longer residence time in kinetic carrier flotation trials.

After 15 minutes 14.7 g Methyl isobutyl carbinol (MIBC) per ton of processed solids are used as frother. Aeration rate of the cell is set to 350 I/h.

Froth samples are collected after 20 sec; 40 sec; 1 min.; 2 min.; 3 min.; 4 min.; 7 min.; 11 min.

iii) Evaluation

The sample slurries are filtered, dried and weighed. Representative aliquots are milled and chemically analyzed using a XRF-device calibrated specifically for the used ore feed.

2a) Primary Carrier Flotation—Inventive i) Conditioning

A 2.6 l Denver-Cell vessel with internal aeration (rotor stator) is used for experiments. The pH of the slurry is set to pH 10 using lime. Rotor speed of Denver Cell is 1500 rpm, collector dosage is 22 g/t potassium amyl xanthate (PAX) and 6 g/t of Diesel (Shellsol D40) related to the dry ore material used. Conditioning time of ore and collector is 3 mins.

Slurry solid content during conditioning and flotation is maintained at 38%

Magnetite (dosage as specified in trial, e.g. 1% of solids) is pre-dispersed for 15 minutes using iso-propanol as wetting agent. Ratio of magnetite/iso-propanol is 0.5.

ii) Flotation

After the conditioning time the magnetite is added to the Denver-Cell vessel. Before the cell is aerated, the slurry and added magnetite are stirred for 15 mins to ensure agglomerate formation.

After 15 mins 14.7 g Methyl isobutyl carbinol (MIBC) per ton of processed solids are used as frother. Total flotation time is 7 minutes. Aeration rate is controlled by opening the valve three-fourths during the first three minutes, followed by four minutes of fully opened aeration valve.

iii) Evaluation

The sample slurries are filtered, dried and weighed. Representative aliquots are milled and chemically analyzed using a XRF-device calibrated specifically for the used ore feed.

2b) Primary Flotation—Comparative i) Conditioning

A 2.6 l Denver-Cell vessel with internal aeration (rotor stator) is used for experiments. The pH of the slurry is set to pH 10 using lime. Rotor speed of Denver Cell is 1500 rpm, collector dosage is 22 g/t potassium amyl xanthate (PAX) and 6 g/t of Diesel (Shellsol D40) related to the dry ore material used. Conditioning time of ore and collector is 3 mins.

Slurry solid content during conditioning and flotation is maintained at 38% ii) Flotation

After the conditioning time the magnetite is added to the Denver-Cell vessel. Before the cell is aerated, the slurry and added magnetite are stirred for 15 mins to accommodate the longer residence time in carrier flotation trials.

After 15 mins 14.7 g methyl isobutyl carbinol (MIBC) per ton of processed solids are used as frother. Total flotation time is 7 minutes. Aeration rate is controlled by opening the valve three-fourths during the first three minutes, followed by four minutes with fully opened aeration valve.

iii) Evaluation

The sample slurries are filtered, dried and weighed. Representative aliquots are milled and chemically analyzed using a XRF-device calibrated specifically for the used ore feed.

RESULTS

TABLE 1

Summary kinetic flotation
inventive vs. comparative flotation - valuable recoveries

| | comparative flotation cumulative recovery | | inventive flotation 0.5% Magnetite cumulative recovery | | | inventive flotation 1.0% Magnetite cumulative recovery | | |
|---|---|---|---|---|---|---|---|---|
| Time [min] | Cu [%] | Mo [%] | Cu [%] | Mo [%] | Magnetite [%] | Cu [%] | Mo [%] | Magnetite [%] |
| 0.33 | 40% | 36% | 3% | 8% | 27% | 17% | 19% | 53% |
| 0.66 | 58% | 54% | 12% | 23% | 61% | 32% | 33% | 79% |
| 1 | 67% | 61% | 21% | 34% | 75% | 44% | 43% | 87% |
| 2 | 76% | 68% | 57% | 60% | 91% | 62% | 59% | 94% |
| 3 | 79% | 69% | 75% | 69% | 94% | 74% | 68% | 97% |
| 4 | 80% | 70% | 81% | 72% | 95% | 79% | 71% | 98% |
| 7 | 82% | 71% | 86% | 76% | 98% | 84% | 75% | 99% |
| 11 | 83% | 71% | 89% | 77% | 100% | 87% | 78% | 100% |

TABLE 2

Summary kinetic flotation
inventive vs. comparative - valuable grades

| | comparative flotation grades | | inventive flotation 0.5% Magnetite grades | | inventive flotation 1.0% Magnetite grades | |
|---|---|---|---|---|---|---|
| Time [min] | Cu [wt %] | Mo [wt %] | Cu [wt %] | Mo [wt %] | Cu [wt %] | Mo [wt %] |
| 0.33 | 8.9% | 0.28% | 6.3% | 0.55% | 5.6% | 0.21% |
| 0.66 | 7.6% | 0.27% | 7.9% | 0.49% | 7.4% | 0.24% |
| 1 | 6.6% | 0.20% | 8.7% | 0.32% | 7.0% | 0.20% |
| 2 | 5.6% | 0.15% | 7.7% | 0.19% | 6.1% | 0.18% |
| 3 | 4.7% | 0.10% | 6.3% | 0.11% | 5.6% | 0.15% |
| 4 | 3.9% | 0.07% | 4.0% | 0.08% | 3.7% | 0.10% |
| 7 | 3.4% | 0.05% | 2.2% | 0.04% | 2.5% | 0.07% |
| 11 | 2.4% | 0.03% | 1.2% | 0.02% | 1.8% | 0.05% |
| total | 7.0% | 0.22% | 5.4% | 0.16% | 5.2% | 0.16% |

TABLE 3

Summary primary flotation
inventive vs. comparative

| | Recovery | | Grade | |
|---|---|---|---|---|
| trial | Cu | Mo | Cu | Mo |
| Comparative | 82.20 | 79.16 | 8.0 | 0.24 |
| inventive (1% magnetite) | 91.83 | 88.00 | 4.55 | 0.13 |

The improvement of recovery could clearly be shown by comparing the conventional flotation process with the inventive process either with 0.5% magnetite or with 1% magnetite for the kinetic flotation as well as for the primary flotation.

The process according to the invention resulted in an increase of the cumulative recovery of about 10% for the valuable metals copper and molybdenum after 11 minutes, while the recovery of the magnetite was 100%.

Although the valuable grades are lower for the inventive process the loss of valuable metals is decreased due to the increase of the valuable recoveries so that in further reworking processes the overall yield can be improved.

The invention claimed is:

1. A process for the separation of at least one hydrophobic or hydrophobized material from a dispersion comprising said at least one hydrophobic or hydrophobized material and at least one second material, wherein the process comprises the following steps:

(A) contacting the dispersion comprising the at least one hydrophobic or hydrophobized material and the at least one second material with at least one hydrophobic or hydrophobized magnetic particle to provide a dispersion I comprising at least one magnetic agglomerate comprising the at least one hydrophobic or hydrophobized material and the at least one hydrophobic or hydrophobized magnetic particle;

(B) separating the at least one magnetic agglomerate from the dispersion I of step (A) by subjecting the dispersion I to flotation;

(C) disaggregating the at least one magnetic agglomerate of step (B) to obtain a dispersion II containing the at least one hydrophobic or hydrophobized material and the at least one hydrophobic or hydrophobized magnetic particle; and (D) separating the at least one hydrophobic or hydrophobized magnetic particle from dispersion II containing the at least one hydrophobic or hydrophobized material by applying a magnetic field.

2. The process according to claim 1, wherein the at least one hydrophobic or hydrophobized material has been pretreated with at least one collector or wherein at least one collector is added in step (A) or (B).

3. The process according to claim 1, wherein the dispersion comprising the at least one hydrophobic or hydrophobized material and the at least one second material in step (A) comprises ore-bearing slag and/or wet ore tailing comprising at least one valuable matter containing material.

4. The process according to claim 3, wherein the valuable matter is selected from the group consisting of Ag, Au, Pt, Pd, Rh, Ru, Ir, Os, Cu, Mo, Ni, Mn, Zn, Pb, Te, Sn, Hg, Re, V, Fe; and combinations or alloys thereof.

5. The process according to claim 3, wherein the at least one valuable matter containing material is present in form of an ore mineral.

6. The process according to claim 1, wherein dispersion I obtained in step (A) comprises from about 5 to about 60% by weight solid content wherein the solid content is based on the total amount of solids present.

7. The process according to claim 1, wherein the at least one hydrophobic or hydrophobized magnetic particle is selected from the group consisting of magnetic metals and mixtures thereof, ferromagnetic alloys of magnetic metals and mixtures thereof, magnetic iron oxides, cubic ferrites of general formula (II)

$$M^{2+}_{x}Fe^{2+}_{1-x}Fe^{3+}_{2}O_4 \quad \text{(II)}$$

wherein

M is selected from the group consisting of Co, Ni, Mn, Zn and mixtures thereof and x is ≤1, hexagonal ferrites and mixtures thereof.

8. The process according to claim 1, wherein the at least one hydrophobic or hydrophobized magnetic particle is a hydrophobized magnetic particle.

9. The process according to claim 1, wherein at least 50% by weight of the whole amount of the at least one second material being present in the dispersion that is originally introduced into the process is separated off in step (B).

10. The process according to claim 1, wherein the at least one hydrophobic or hydrophobized magnetic particle separated in step (D) is recycled into step (A) again.

11. The process according to claim 1, wherein the at least one hydrophobic or hydrophobized material and the at least one second material are comminuted to particles having a particle size of from about 100 nm to about 400 μm in or before step (A) or (B).

12. The process according to claim 1, wherein step (D) is repeated 1, 2, 3 or 4 times.

13. The process according to claim 1, wherein the at least one hydrophobic or hydrophobized material is a hydrophobic or hydrophobized valuable matter containing material.

14. The process according to claim 1, wherein the recovery of valuable matter is from about 80% to about 100%.

15. The process according to claim 1, wherein the recovery of valuable matter is from about 2% points to about 30% points higher compared to usual processes using flotation.

16. The process according to claim 1, wherein physical or chemical data are measured in at least one of the steps (A) to (D) to provide feedback to a process control circuit.

17. The process according to claim 1, wherein the at least one hydrophobic or hydrophobized material has been pretreated with at least one collector or wherein at least one collector is added in step (A) or (B), and wherein the at least one collector is a compound of formula (I) or derivative thereof $$[(A)_m(Z)_n]_o \quad \text{(I)}$$

wherein each A is independently selected from $C_1$-$C_{30}$-alkyl, $C_2$-$C_{30}$-alkenyl $C_1$-$C_{30}$-heteroalkyl, $C_6$-$C_{30}$-aryl, $C_6$-$C_{30}$-cycloalkyl, $C_6$-$C_{30}$-heteroalkyl, $C_6$-$C_{30}$-heterocycloalkyl, $C_6$-$C_{30}$-aralkyl, each of which are optionally substituted;

m is an integer of 1, 2, 3, 4, 5, 6, 7, 8, 9 or 10;

n is an integer of 1, 2, 3, 4, 5, 6, 7, 8, 9 or 10; and o is an integer of 1, 2, 3, 4, 5, 6, 7, 8, 9 or 10 to 100, each Z is independently selected from:

a)

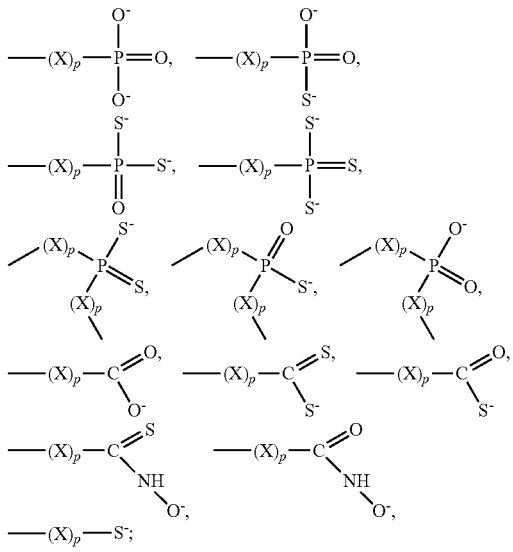

b)

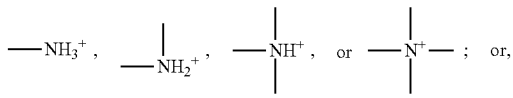

c)

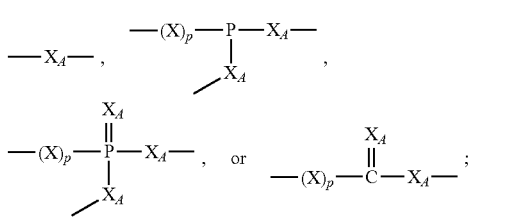

wherein each X is independently selected from the group consisting of O, S, NH, $CH_2$ and each p is independently selected from the integer 0, 1 or 2 and each $X_A$ is independently selected from O or S.

18. The process according to claim 1, wherein the at least one hydrophobic or hydrophobized material has been pretreated with at least one collector or wherein at least one collector is added in step (A) or (B), and wherein the at least one collector is selected from:

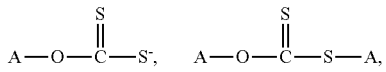

-continued

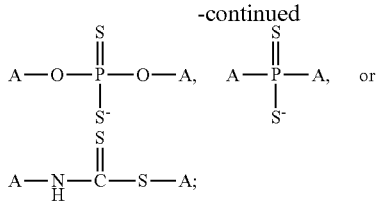

or a derivative thereof each A is independently selected from $C_1$-$C_{30}$-alkyl, $C_2$-$C_{30}$-alkenyl $C_1$-$C_{30}$-heteroalkyl, $C_6$-$C_{30}$-aryl, $C_6$-$C_{30}$-cycloalkyl, $C_6$-$C_{30}$-heteroalkyl, $C_6$-$C_{30}$-heterocycloalkyl, $C_6$-$C_{30}$-aralkyl, each of which are optionally substituted.

19. The process according to claim 1, wherein the at least one hydrophobic or hydrophobized magnetic particle is a hydrophobized magnetic particle, and wherein the at least one hydrophobized magnetic particle is a magnetic particle treated with a hydrophobizing agent which is a compound of formula (IV) or derivative thereof $$R^5_v—Si(OR^6)_{4-v} \quad (IV)$$

wherein each $R^5$ is independently selected from hydrogen; linear or branched, optionally substituted $C_1$-$C_{30}$-alkyl; linear or branched, optionally substituted $C_2$-$C_{30}$-alkenyl; linear or branched, optionally substituted $C_2$-$C_{30}$-alkynyl; optionally substituted $C_3$-$C_{20}$-cycloalkyl; optionally substituted $C_3$-$C_{20}$-cycloalkenyl; optionally substituted $C_1$-$C_{20}$-heteroalkyl; optionally substituted $C_5$-$C_{22}$-aryl; optionally substituted $C_6$-$C_{23}$-alkylaryl; optionally substituted $C_6$-$C_{23}$-arylalkyl; optionally substituted $C_5$-$C_{22}$-heteroaryl;

each $R^6$ is independently selected from hydrogen; linear or branched, optionally substituted $C_1$-$C_{30}$-alkyl; linear or branched, optionally substituted $C_2$-$C_{30}$-alkenyl; linear or branched, optionally substituted $C_2$-$C_{30}$-alkynyl; optionally substituted $C_3$-$C_{20}$-cycloalkyl; optionally substituted $C_3$-$C_{20}$-cycloalkenyl; optionally substituted $C_1$-$C_{20}$-heteroalkyl; optionally substituted $C_5$-$C_{22}$-aryl; optionally substituted $C_6$-$C_{23}$-alkylaryl; optionally substituted $C_6$-$C_{23}$-arylalkyl; optionally substituted $C_5$-$C_{22}$-heteroaryl;

and v is the integer 1, 2 or 3.

20. The process according to claim 1, wherein the at least one hydrophobic or hydrophobized magnetic particle is a hydrophobized magnetic particle, and wherein the at least one hydrophobized magnetic particle is a magnetic particle treated with a hydrophobizing agent which is a compound selected from the group consisting of $(NaO)(CH_3)Si(OH)_2$, $(NaO)(C_2H_5)Si(OH)_2$, $(NaO)(C_5H_{11})Si(OH)_2$, $(NaO)(C_8H_{17})Si(OH)_2$, $(KO)(CH_3)Si(OH)_2$, $(KO)(C_2H_5)Si(OH)_2$, $(KO)(C_5H_{11})Si(OH)_2$, $(KO)(C_8H_{17})Si(OH)_2$, $(NH_4O)(CH_3)Si(OH)_2$, $(NH_4O)(C_2H_5)Si(OH)_2$, $(NH_4O)(C_5H_{11})Si(OH)_2$, $(NH_4O)(C_8H_{17})Si(OH)_2$, $(NaO)_2(CH_3)Si(OH)$, $(NaO)_2(C_2H_5)Si(OH)$, $(NaO)_2(C_5H_{11})Si(OH)$, $(NaO)_2(C_8H_{17})Si(OH)$, $(KO)_2(CH_3)Si(OH)$, $(KO)_2(C_2H_5)Si(OH)$, $(KO)_2(C_5H_{11})Si(OH)$, $(KO)_2(C_8H_{17})Si(OH)$, $(NH_4O)_2(CH_3)Si(OH)$, $(NH_4O)_2(C_2H_5)Si(OH)$, $(NH_4O)_2(C_5H_{11})Si(OH)$, $(NH_4O)_2(C_8H_{17})Si(OH)$, $(NaO)_3(CH_3)Si$, $(NaO)_3(C_2H_5)Si$, $(NaO)_3(C_5H_{11})Si$, $(NaO)_3(C_8H_{17})Si$, $(KO)_3(CH_3)Si$, $(KO)_3(C_2H_5)Si$, $(KO)_3(C_5H_{11})Si$, $(KO)_3(C_8H_{17})Si$, $(NH_4O)_3(CH_3)Si$, $(NH_4O)_3(C_2H_5)Si$, $(NH_4O)_3(C_5H_{11})Si$, $(NH_4O)_3(C_8H_{17})Si$, $(NaO)(CH_3)_2Si(OH)$, $(NaO)(C_2H_5)_2Si(OH)$, $(KO)(CH_3)_2Si(OH)$, $(KO)(C_2H_5)_2Si(OH)$, $(NaO)_2(CH_3)_2Si$, $(NaO)_2(C_2H_5)_2Si$, $(KO)_2(CH_3)_2Si$, $(KO)_2(C_2H_5)_2Si$, $Ca^{2+}[(O^-)(CH_3)Si(OH)_2]_2$, $Ca^{2+}[(O^-)(C_2H_5)Si(OH)_2]_2$, $Ca^{2+}[(O^-)(C_5H_{11})Si(OH)_2]_2$, $Ca^{2+}[(O^-)(C_8H_{17})Si(OH)_2]_2$, $Ca^{2+}[(O^-)(CH_3)_2Si(OH)]_2$, $Ca^{2+}[(O^-)(C_2H_5)_2Si(OH)]_2$, $Ca^{2+}[(O^-)_2(CH_3)Si(OH)]$, $Ca^{2+}[(O^-)_2(C_2H_5)Si(OH)]$, $Ca^{2+}[(O^-)_2(C_5H_{11})Si(OH)]$, $Ca^{2+}[(O^-)_2(C_8H_{17})Si(OH)]$, $Ca^{2+}[(O^-)_2(CH_3)_2Si]$, $Ca^{2+}[(O^-)_2(C_2H_5)_2Si]$ and combinations thereof.

* * * * *